US005896074A

United States Patent [19]

Matsumoto et al.

[11] Patent Number: 5,896,074

[45] Date of Patent: *Apr. 20, 1999

[54] DIELECTRIC FILTER

[75] Inventors: Haruo Matsumoto; Yasuo Yamada; Yukihiro Kitaichi; Tadahiro Yorita; Hideyuki Kato; Tatsuya Tsujiguchi; Hisashi Mori; Hitoshi Tada, all of Nagaokakyo, Japan

[73] Assignee: Murata Manufacturing Co., Ltd., Japan

[ * ] Notice: This patent is subject to a terminal disclaimer.

[21] Appl. No.: 08/874,259

[22] Filed: Jun. 13, 1997

Related U.S. Application Data

[62] Division of application No. 08/843,433, Apr. 15, 1997, which is a continuation of application No. 08/664,028, May 24, 1996, abandoned, which is a continuation of application No. 08/459,253, Jun. 2, 1995, abandoned, which is a division of application No. 08/259,568, Jun. 14, 1994, Pat. No. 5,642,084, which is a division of application No. 08/009,308, Jan. 22, 1993, abandoned.

[30] Foreign Application Priority Data

| | | | |
|---|---|---|---|
| Jan. 22, 1992 | [JP] | Japan | 4-9207 |
| Apr. 3, 1992 | [JP] | Japan | 4-29056 U |
| Oct. 20, 1992 | [JP] | Japan | 4-312720 |

[51] Int. Cl.[6] ..... H01P 1/205; H01P 7/04

[52] U.S. Cl. ..... 333/206; 333/222

[58] Field of Search ..... 333/202, 206, 333/207, 222, 223

[56] References Cited

U.S. PATENT DOCUMENTS

| | | | |
|---|---|---|---|
| 4,431,977 | 2/1984 | Sokola et al. | 333/206 |
| 5,103,197 | 4/1992 | Turunen et al. | 333/206 |
| 5,109,207 | 4/1992 | Aizawa et al. | 333/222 |
| 5,572,174 | 11/1996 | Kitaichi et al. | 333/206 |

FOREIGN PATENT DOCUMENTS

| | | | |
|---|---|---|---|
| 59-161902 | 9/1984 | Japan | 333/202 |
| 62-40802 | 2/1987 | Japan . | |
| 62-183603 | 8/1987 | Japan . | |
| 63-90203 | 4/1988 | Japan | 333/202 |
| 1-220501 | 9/1989 | Japan | 333/202 |
| 4-103203 | 4/1992 | Japan | 333/202 |
| 2163606 | 2/1986 | United Kingdom . | |
| 2240432 | 7/1991 | United Kingdom . | |
| 83/02853 | 8/1983 | WIPO . | |
| 85/00929 | 2/1985 | WIPO . | |

*Primary Examiner*—Seungsook Ham

*Attorney, Agent, or Firm*—Ostrolenk, Faber, Gerb & Soffen, LLP

[57] ABSTRACT

Dielectric resonator wherein an internal conductor non-formed portion is provided near one open face of the internal conductor formed holes, and signal input, output electrodes are provided on one portion of the external conductor, whereby electromagnetic field leakage is restrained, because the open face is not formed, and individual parts such as signal input, output pins and so on are not required.

20 Claims, 20 Drawing Sheets

DIELECTRIC FILTER

This is a Division of application Ser. No. 08/843,433, filed Apr. 15, 1997, now pending, which is Continuation of application Ser. No. 08/664,028, filed May 24, 1996, now abandoned, which is a Continuation of application Ser. No. 08/459,253, filed Jun. 2, 1995, now abandoned, which is a Division of application Ser. No. 08/259,568, filed Jun. 14, 1994, now U.S. Pat. No. 5,642,084, which is a Division of application Ser. No. 08/009,308, filed Jan. 22, 1993, now abandoned.

BACKGROUND OF THE INVENTION

The present invention generally relates to a dielectric resonator, with an internal conductor which is formed within a dielectric, and an external conductor which is formed on the outside face of the dielectric, and a method for adjusting the characteristics of a dielectric resonator.

A dielectric resonator, where a resonator electrode is formed within a dielectric block and an earth electrode is formed on the outside face of the dielectric block, and a so-called tri-plate type of dielectric resonator with strip lines that are opposite to each other by the use of a dielectric basic plate with a strip line being formed on one main face and an earth electrode which is formed on the other main face, are used as a band passing filter and so on in, for example, the microwave band.

FIG. 39 shows as an exploded perspective view the construction of the conventional general dielectric resonator using the dielectric block. In FIG. 39, reference numeral 40 is a six-sided dielectric block with three internal conductor shaped holes 46, 47, 48 having an internal conductor provided therein and coupling holes 49, 50 which are provided among the internal conductor formed holes 46, 47, 48. The internal conductor is formed on the inside surface of the internal conductor formed holes 46, 47, 48, and an external conductor 51 is formed on five faces of the dielectric block 40 except for an open face 52. Reference numerals 53, 54 are so-called resin pins, each being composed of resin portions 53*a*, 54*a* and signal input, output terminals 53*b*, 54*b*. Two resin pins 53, 54 are inserted into the internal conductor formed holes 46, 48 from the open face side of the dielectric block 40 so that the terminals 53*b*, 54*b* are coupled in capacity to the internal conductor within the internal conductor formed holes 46, 48. Reference numeral 55 is a case for retaining the dielectric block 40 and the resin pins 53, 54 and also, for covering the open face portion of the dielectric block 40. The resin pins 53, 54 are respectively inserted into the dielectric block 40 so as to cover the case 55, and also, the whole arrangement is integrated by soldering the dielectric block 40 with the external conductor 51. In mounting the dielectric resonator, the projecting portions 55*a*, 55*b* of the case 55 function as an earth terminal.

As shown in FIG. 39, many of the components such as input, output terminals 53*b*, 54*b*, case 55 and so on, are necessary if a plurality of resonators are to be formed on a single dielectric block. The assembling steps therefore become complicated. Moreover the completed products, which have to be mounted as electronic components, require that a lead wire attached to the component be mounted in the mounting operation of the completed product on the circuit basic plate. Therefore, the surface mounting operation cannot be effected, as in other electronic components, so as to mount these completed products on the same circuit basic plate, so that a lower height operation is hard to effect. If the case 55 is not used, by the direct connection of the external conductor 51 of the dielectric block 40 to the earth electrode on the circuit basic plate, the open face 52 is exposed, and, therefore, electromagnetic field leakage is caused in this portion. When a metallic member approaches toward the open face 52, the influences of the metallic member are received. Also, the resonator is connected with electromagnetic field from the outside so that the desired characteristics of the dielectric resonator cannot be obtained.

SUMMARY OF THE INVENTION

Accordingly, the present invention has been developed with a view to substantially eliminate the above discussed drawbacks that are inherent in the prior art, and has for its essential object to provide an improved dielectric resonator.

Another important object of the present invention is to provide an improved dielectric resonator which can be surface mounted on the circuit basic plate without the use of resin pins 53, 54 and a case 55 as individual parts, as required by the prior art device shown in FIG. 39.

Still another object of the present invention is to provide a dielectric resonator where electromagnetic field leakage between the inside and the outside of the resonator near the opening portion is restrained so as to remove the problem caused by the above described electromagnetic field leakage.

A further object of the present invention is to provide a characteristic adjusting method of a dielectric resonator capable of adjusting the desired resonator characteristics with ease and high accuracy.

A still further object of the present invention is to provide a dielectric resonator in which it is easier to obtain floating capacity by a comparatively simple working or molding operation.

In accomplishing these and other objects, a dielectric resonator in accordance with a first aspect of the invention is provided having a portion of the internal conductor not formed near at least one open face of the above described internal conductor formed holes, and signal input, output electrodes for providing capacity connection with the above described internal conductor are provided on one portion of the outer conductor. The dielectric resonator includes a plurality of internal conductor formed holes within the dielectric block with the external conductor being formed on the outside face of the above described dielectric block.

In the dielectric resonator of the first aspect of the invention, the non-formed portion of the internal conductor is provided near at least one open face of the internal conductor formed holes of the dielectric resonator, and signal input, output electrodes for effecting capacity connection with the internal conductor are provided on one portion of the external conductor. A tip end capacity is caused in the non-formed portion of the internal conductor in the internal conductor formed hole so as to provide column-in coupling or interdigital connection between the adjacent resonators. In this construction, the conductor is not removed from the open face of the internal conductor formed holes, so that large electromagnetic field leakage is not caused. As the coupling holes are not required, the whole arrangement can be easily made smaller in size. As the signal input, output electrodes are provided in one portion of the external conductor so as to provide a capacity connection with the internal conductor, the signal input, output terminals as separate, individual parts are not required. The external conductor is connected with the earth electrode on the circuit basic plate by the surface mounting operation on the circuit basic plate, and also, the signal input, output electrodes can be similarly connected with the signal line on the circuit basic plate.

A dielectric resonator of a second aspect of the invention described in accordance with the first aspect of the invention is characterized in that the above described dielectric resonator is an approximately six-face unit in shape so as to form the above described signal input, output electrodes only on the circuit basic plate mounting face.

In the dielectric resonator of the second aspect of the invention, the above described signal input, output electrodes are formed only on the mounting face with respect to the circuit basic plate. Therefore, electromagnetic field leakage of the signal input, output electrodes is reduced with the dielectric resonator being mounted on the circuit basic plate, changes in the resonator characteristics by the influences of the metallic member and so on of the peripheral portion are less, and unnecessary connection with the other circuit portion is not required thereby simplifying the circuit designing operation. Further, the pattern formation is simplified, because the signal input, output electrodes have only to be formed within one plane.

A dielectric resonator of a third aspect of the invention, where a plurality of internal conductor formed holes within the dielectric are provided, an external conductor is formed on the outside face of the above described dielectric resonator, one open face of the above described internal conductor formed holes is made a short-circuit face, and also, a non-formed portion of the internal conductor is provided near the other open face, signal input, output electrodes for providing capacity connection with the above described internal conductor are provided on one portion of the external conductor, and portions of the conductor and the dielectric are removed from one portion of the above described short-circuit face, the above described other open face, or both the faces.

In the dielectric resonator of the third aspect of the invention, one open face of the above described internal conductor formed holes is made a short-circuit face, and also, a non-formed portion of the internal conductor is provided near the other open face, signal input, output electrodes for providing capacity connection with the above described internal conductor are provided on one portion of the external conductor, and portions of the conductor and the dielectric are not formed in one portion of the open face where the non-formed portion of the internal conductor is provided, or the short-circuit face, or both the faces. If portions of the conductor and the dielectric are deleted in the open face where the non-formed portion of the internal conductor is provided, the resonance frequency of the resonator can be raised. If the conductor and the dielectric between the open portions of adjacent internal conductor formed holes in the short circuit face are deleted, the coupling between the resonators is weakened and also, the resonance frequency of the resonator can be lowered. If the conductor and the dielectric around the internal conductor formed holes except for between the open portions of the adjacent internal conductor formed holes are deleted, the resonance frequency of the resonator can be lowered. Therefore, the coupling adjusting and the frequency adjustment can be easily effected without coating addition and so on of the conductor on the non-formed portion of the conductor.

A dielectric resonator of a fourth aspect of the invention where internal conductor formed holes with an internal conductor being formed on the inside surface are provided on the dielectric, and an external conductor is provided on the outside face of the dielectric, characterized in that hollows are formed near the internal conductor formed holes in at least one open face of the internal conductor formed holes so as to delete the internal conductor near the above described hollow formed portions.

In the dielectric resonator of the fourth aspect of the invention, hollows with an internal conductor formed hole as a center are formed on at least one open face of the internal conductor formed holes of the dielectric resonator, and the internal conductor near the hollow formed holes is deleted. The open portion of the internal conductor is formed in a location secluded from the opening face. The open portion of the internal conductor is provided on the inside away from the open face of the internal conductor formed holes, and electromagnetic field leakage between the inside and the outside of the dielectric resonator is lessened so that stable resonator characteristics are obtained.

A dielectric resonator of a fifth aspect of the invention where internal conductor formed holes with an internal conductor being formed on the inside face thereof are provided in the dielectric, and the external conductor is formed on the outside face of the dielectric, one portion of the internal conductor is deleted near the open face of the internal conductor formed holes and in a location secluded from the open face.

In the dielectric resonator of the fifth aspect of the invention, one portion of the internal conductor is deleted near the open face of the internal conductor formed holes and in the location secluded from the open face. As the open portion of the internal conductor is formed in the location secluded from the open face of the resonator, the electromagnetic field leakage is prevented.

A dielectric resonator of a sixth aspect of the invention where internal conductor formed holes with an internal conductor being formed on the inside face are provided in the dielectric, and external conductors are formed on the outside face of the dielectric, characterized in that a throttle portion is formed in at least one open portion of the internal conductor formed holes, and the internal conductor is deleted near the throttle portion and on the internal conductor formed hole side.

In the dielectric resonator of the sixth aspect of the invention, a throttle portion is formed on at least one open face of the internal conductor formed holes, and the internal conductor is deleted near the throttle portion and on the internal conductor formed hole side. Accordingly, the open portion of the internal conductor is formed in a location secluded from the open face of the internal conductor formed holes so as to prevent the electromagnetic field leakage.

A dielectric resonator of a seventh aspect of the invention where internal conductor formed holes with an internal conductor being formed in the inside face are provided in the dielectric, and the external conductor is formed on the outside face of the dielectric, a throttle portion is formed in a location near one open face of the internal conductor formed holes and secluded from the open face so as to delete the internal conductor of the above described throttle portion.

In a dielectric resonator of the seventh aspect of the invention, a throttle portion is formed in a location near one open face of the internal conductor formed holes and secluded from the open face so as to delete the internal conductor of the above described throttle portion. Therefore, as the open portion of the internal conductor is formed in a location secluded from the open face of the internal conductor formed holes, the electromagnetic field leakage is prevented.

A dielectric resonator of an eighth aspect of the invention is made resonant with a desired frequency by forming the inside conductor on the inside face of a hole in the dielectric, and forming the outside conductor on the outside face of the above described dielectric; a concave portion is formed on the surface of the above described dielectric so as to cause the outside conductor in the bottom portion of the concave portion to approach the above described inside conductor.

In the eighth aspect of the invention, the outside conductor at the bottom portion of the concave portion formed on the surface of the dielectric is brought towards the above described inside conductor, the interval between the inside conductor of the hole of the dielectric and the outside conductor, which becomes an earth electrode, becomes smaller, and floating capacity is likely to be obtained. The floating capacity can be adjusted by a comparatively simple working or molding operation of the size, depth and so on of the concave portion. In the comb-line type resonator, the band width of the filter can be made larger by provision of, for example, larger floating capacity. The resonator length becomes shorter, and the size can be made smaller by the provision of, for example, larger floating capacity.

A dielectric resonator of a ninth aspect of the invention where a taper portion is formed on a corner portion of the dielectric so as to cause the outside conductor of the taper portion to approach toward the inside conductor.

In the ninth aspect of the invention, the taper portion is formed on a corner portion of the dielectric so as to cause the outside conductor at the taper portion to approach toward the inside conductor, so that the distance between the inside conductor of the hole in the interior of the dielectric and the outside conductor, which becomes an earth electrode is reduced, and floating capacity is likely to be obtained as in the previous aspect of the invention. The floating capacity can be adjusted by a comparatively simple working or molding operation of the size, inclination and so on of the taper portion in the corner portion of the dielectric. In the comb-line type resonator, the band width of the filter may be made larger by the provision of, for example, larger floating capacity. The resonator length becomes shorter and the size become smaller by the provision of, for example, the larger floating capacity.

A dielectric resonator of a tenth aspect of the invention where a concave stage portion of approximately L type (in section) is provided in a corner portion of the dielectric so as to cause the outside conductor of the concave stage portion to approach toward the inside conductor.

In the tenth aspect of the invention, a concave stage portion of approximately L type (in section) is provided in the corner portion of the dielectric so as to cause the outside conductor at the concave stage portion to approach toward the inside conductor, so that the distance between the inside conductor of the hole in the interior of the dielectric and the outside conductor, which becomes an earth electrode, becomes shorter, and floating capacity is likely to be obtained. The floating capacity can be adjusted by a comparatively simple working or molding operation of the size, depth and so on of the concave stage portion in the corner portion of the dielectric. In the comb-line type resonator, the band width of the filter may be made larger by the provision of, for example, larger floating capacity. The resonator length becomes shorter and the size becomes smaller by the provision of, for example, the larger floating capacity.

A characteristic adjusting method of a dielectric resonator of an eleventh aspect of the invention, where internal conductor formed holes with an internal conductor formed on the inside face therein the external conductor being formed on the outside face of the dielectric, comprising the steps of deleting the internal conductor near the above described hollow formed portion, adjusting the tip end capacity of the internal conductor with a hollow that is formed near the internal conductor formed hole in at least one open face of the above described internal conductor formed holes.

In the characteristic adjusting method of the dielectric resonator of the eleventh aspect of the invention, a hollow is initially formed, with the opening of the internal conductor formed hole being provided as a center, on at least one open face of the internal conductor formed holes, and the internal conductor near the hollow formed portion is deleted. The internal edge portion of the internal conductor formed hole opening portion is not deleted by the deletion of the internal conductor near the hollow formed portion. One portion of the internal conductor and the dielectric can be deleted with high accuracy. As a result, the desired resonator characteristics can be obtained with ease and in a short time by the adjustment of the resonator characteristics to high accuracy.

A characteristic adjusting method of a dielectric resonator of a twelfth aspect of the invention where an internal conductor formed hole with an internal conductor being formed on the inside face is provided in the dielectric and the external conductor is formed on the outside face of the dielectric, comprising the steps of initially forming a throttle portion on one open face of the above described internal conductor formed hole, deleting the internal conductor formed on the above described throttle portion, adjusting the tip end capacity of the internal conductor.

In a characteristic adjusting method of a dielectric resonator of the twelfth aspect of the invention, a throttle portion is initially formed on one open portion of the internal conductor formed hole, the tip end capacity of the internal conductor is adjusted by the deletion of the internal conductor formed on the throttle portion. As the internal conductor and the dielectric are deleted only in the throttled portion, in the deleting operation of the internal conductor formed initially on the throttled portion, the adjustment can be carried out with high accuracy.

A characteristic adjusting method of a dielectric resonator of a thirteenth aspect of the invention where internal conductor formed holes with an internal conductor being formed on the inside face are provided in the dielectric and the external conductor is formed on the outside face of the dielectric, comprising the steps of initially forming a throttle portion in a location near one open face of the above described conductor formed holes and secluded from the open face, deleting the internal conductor formed on the above described throttle portion, and adjusting the tip end capacity of the internal conductor.

In a characteristic adjusting method of the thirteenth aspect of the invention, a throttle portion is initially formed in a location near one open face of the internal conductor formed holes and secluded from the open face, the internal conductor formed on the throttle portion is deleted, and the tip end capacity of the internal conductor is adjusted in this manner. The adjusting operation can be carried out with high accuracy so as to delete the internal conductor initially formed on the throttle portion.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF PREFERRED EMBODIMENT OF THE INVENTION

Figure 1:
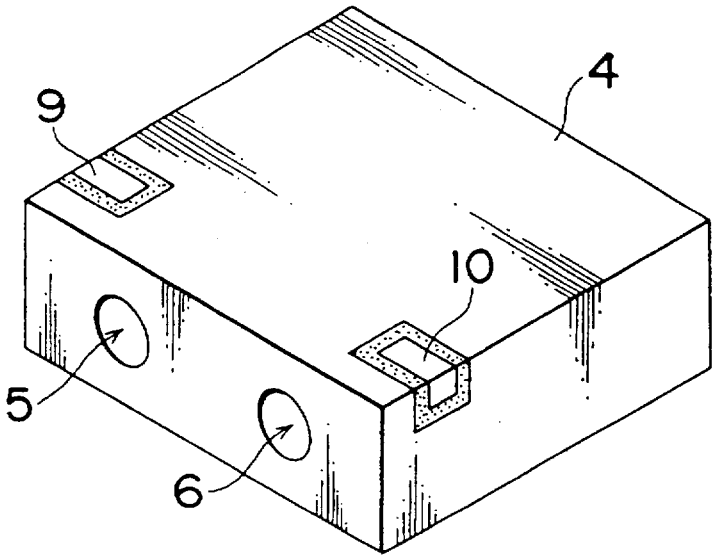
FIG. 1 is a perspective view of a dielectric resonator which is made in accordance with a first embodiment.

Before the description of the preferred embodiment of the present invention proceeds, it is to be noted that like parts are designated by like reference numerals throughout the accompanying drawings.

(First Embodiment)

The construction of a dielectric resonator and a characteristic adjusting method thereof in a first embodiment of the present invention will be described hereinafter in accordance with FIG. 1 through FIG. 6.

FIG. 1 is a perspective view of a dielectric resonator. In FIG. 1, reference numerals 5, 6 are holes having an internal conductor provided therein, hereinafter referred to as internal conductor formed holes. The internal conductor formed holes 5, 6 are formed in a dielectric block having generally six sides. The internal conductor is formed in advance on the inside surfaces of the internal conductor formed holes 5, 6. An external conductor 4 is formed on all the outside faces (six faces) of the dielectric block. Signal input, output electrodes, shown by reference numerals 9, 10, are formed in the respective portions of the external conductor 4, as shown in FIG. 1.

Figure 2:
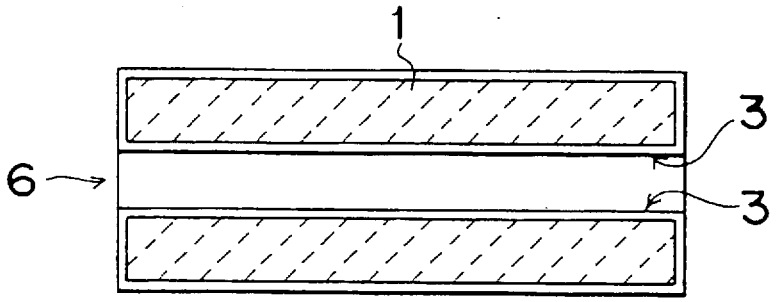
FIG. 2 is a sectional view of the dielectric resonator which is made in accordance with the first embodiment.
Figure 3:
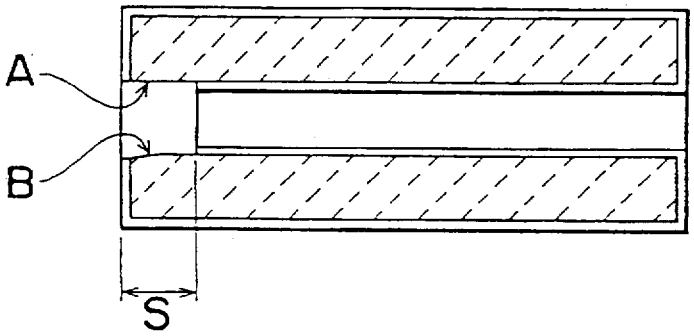
FIG. 3 is a sectional view of a dielectric resonator in accordance with the first embodiment after deletion of a portion of the inner conductor.
Figure 4:
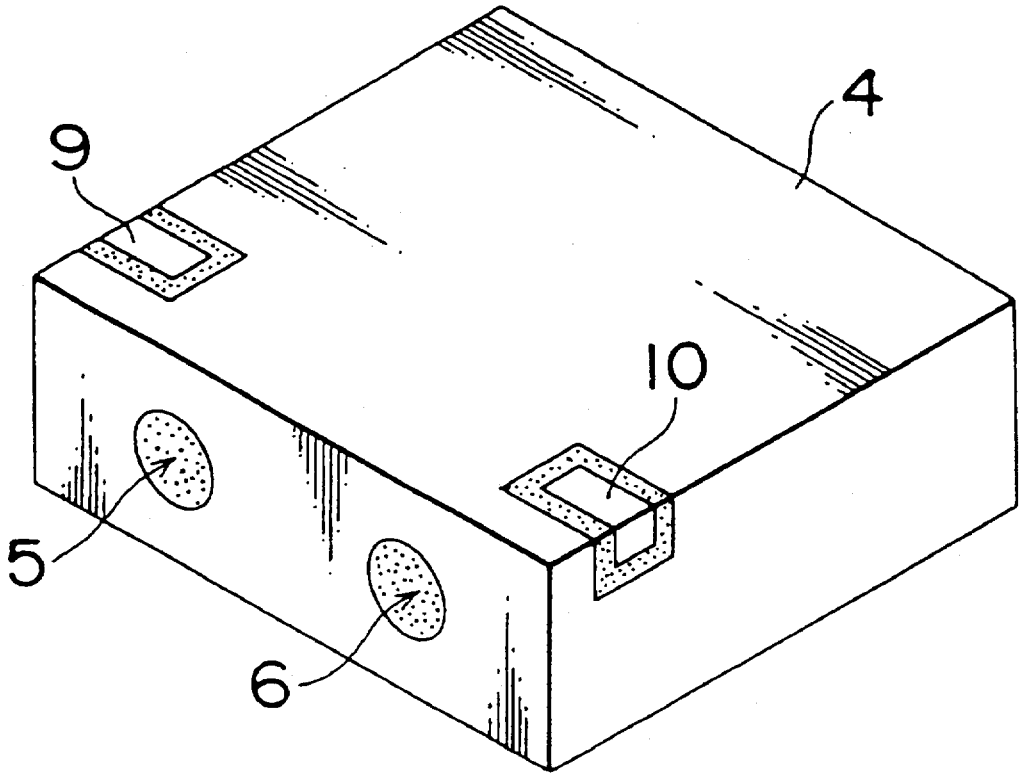
FIG. 4 is a perspective view of a dielectric resonator in accordance with the first embodiment after deletion of a portion of the inner conductor.
Figure 5:
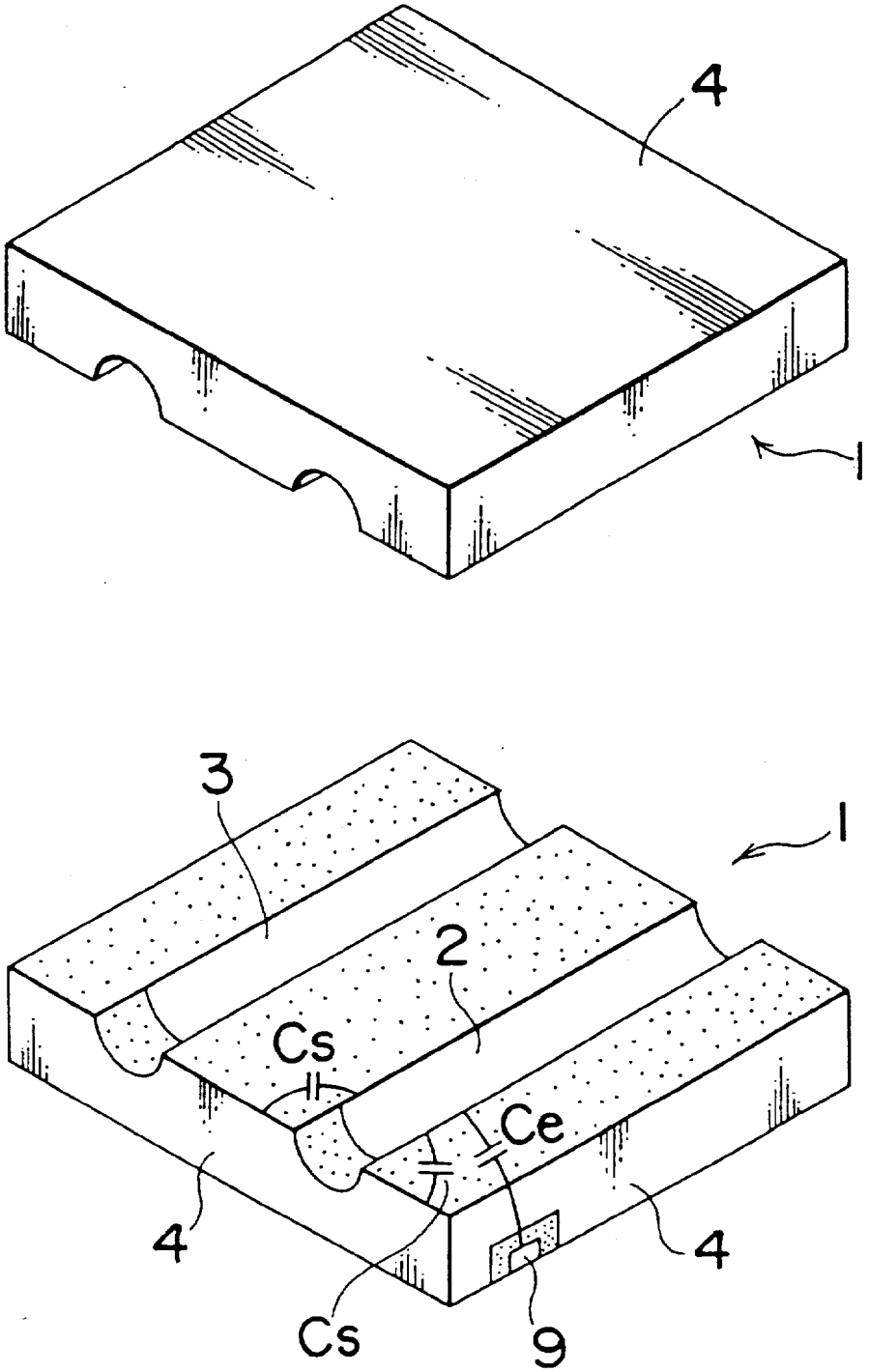
FIG. 5 is an exploded perspective view of the dielectric resonator in accordance with the first embodiment.

FIG. 2 is a vertical sectional view passing through the internal conductor formed hole 6 in FIG. 1. An internal conductor, shown by reference numeral 3 is formed on the entire inside face of the internal conductor formed hole 6. A non-formed portion (hereinafter referred to as an open portion) of the inner conductor is provided in one portion of the internal conductor when a dielectric resonator having desired resonating characteristics is to be obtained from such a dielectric block. As shown in FIG. 3, the internal conductor near one opening of the internal conductor formed holes 5, 6 is not formed so as to adjust the resonance frequency and the coupling degree of the dielectric resonator. FIG. 4 is a perspective view showing a dielectric resonator after the open portion is formed. FIG. 3 is a vertical sectional view thereof. In FIG. 3, a portion is made an open portion by the internal conductor near the opening of the internal conductor formed hole, shown with the letters A, B being deleted. FIG. 5 is a view where the dielectric resonator shown in FIG. 4 is cut and separated with the central horizontal face having the signal input, output electrodes 9, 10 facing downward. A tip end capacity Cs is caused, between the tip end portion of the internal conductor 2 and the external conductor 4, in the open portion of, for example, the internal conductor 2, and an external coupling capacity Ce is caused between the tip end portion vicinity of the internal conductor 2 and the signal input, output electrode 9. The tip end capacity is adjusted by a size S, shown in FIG. 3, of the open portion thereby adjusting the coupling degree between the resonance frequency of the resonator and the resonator.

Figure 6:
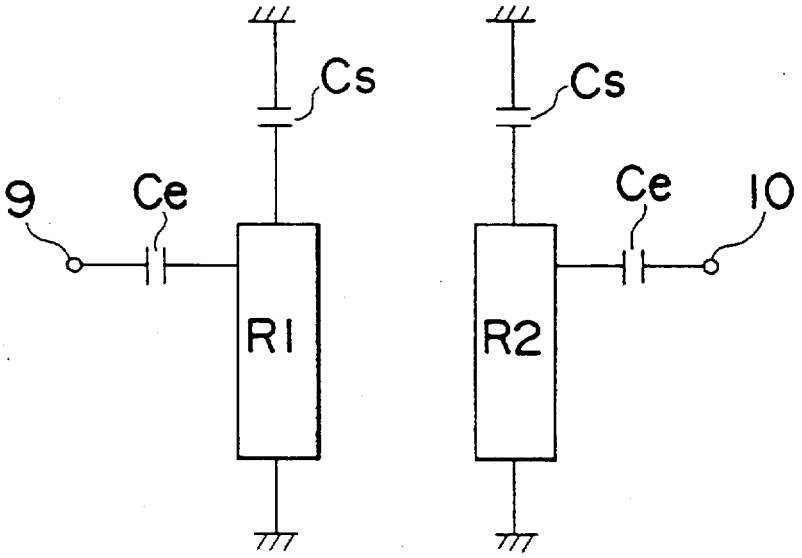
FIG. 6 is an equivalent circuit diagram of the dielectric resonator in accordance with the first embodiment.

FIG. 6 is an equivalent circuit diagram of the dielectric resonator shown in FIG. 1 through FIG. 5. In FIG. 6, reference character R1 is a resonator with the internal conductor 2, reference character R2 is a resonator with the internal conductor 3. Reference character Cs is a tip end capacity that is formed in the open portion of the respective internal conductors 2, 3. Reference character Ce is an external coupling capacity that is formed between the signal input, output electrodes 9, 10 and the open portions of the internal conductors 2, 3.

(Second Embodiment)

Figure 7A:
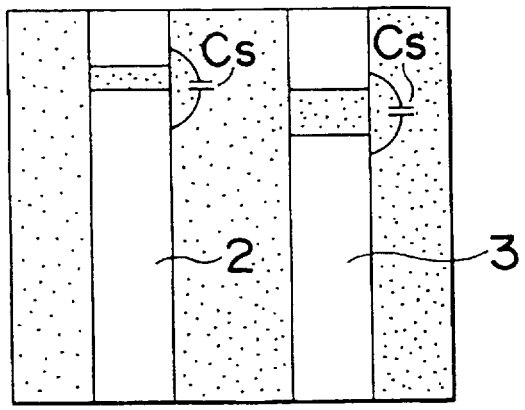
FIGS. 7A and B show the construction of a dielectric resonator in accordance with a second embodiment; (A) is a horizontal sectional view and (B) is a front face view.
Figure 7B:
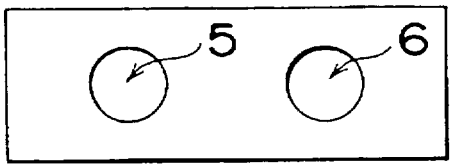

The construction of a dielectric resonator in a second embodiment, which is different in the position of the open portion formed within the internal conductor formed hole, is shown in FIG. 7. FIG. 7A is a central horizontal sectional view of a dielectric block FIG. 7B is a front face view seen from the short-circuit face side of the dielectric block. The open portions of the internal conductors 2, 3, which are provided within the internal conductor formed holes 5, 6 are situated in locations spaced away from the openings of the internal conductor formed holes 5, 6 so as to form the tip end capacity Cs in the open portions. Thus, electromagnetic field leakage can be further prevented.

(Third Embodiment)

Figure 8:
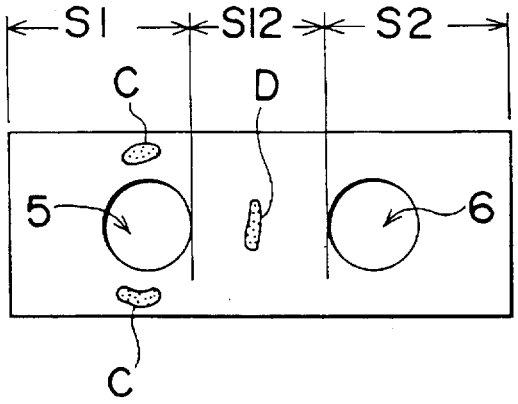
FIG. 8 is a front face view of a dielectric resonator in accordance with a third embodiment.
Figure 9:
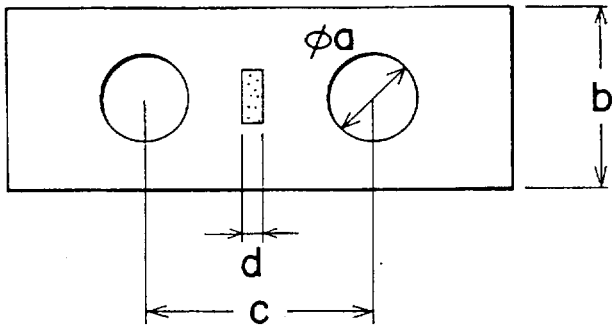
FIG. 9 is a front face view showing a conductor deleted embodiment for the characteristics measurement of the dielectric resonator in accordance with the third embodiment.
Figure 10:
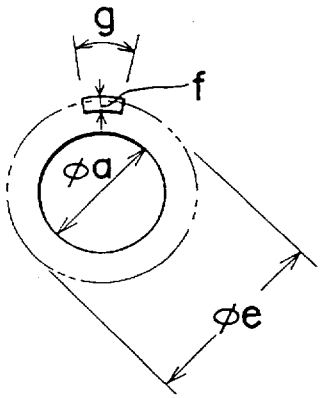
FIG. 10 is a partial front face view showing the conductor deleted embodiment for the characteristics measurement of the dielectric resonator in accordance with the third embodiment.
Figure 11:
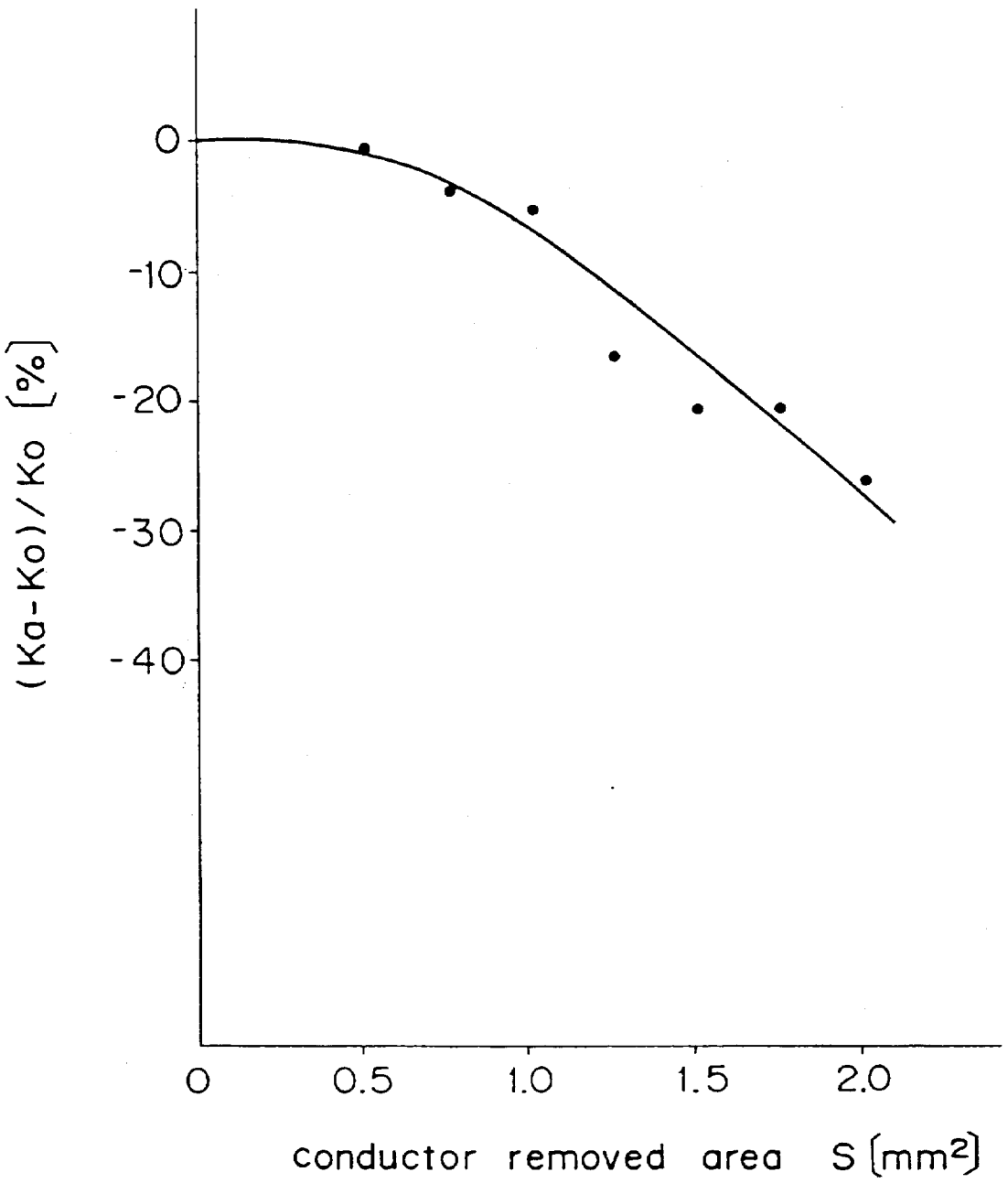
FIG. 11 is a graph showing the measurement result in the coupling coefficient changes of the dielectric resonator in accordance with the third embodiment.
Figure 12:
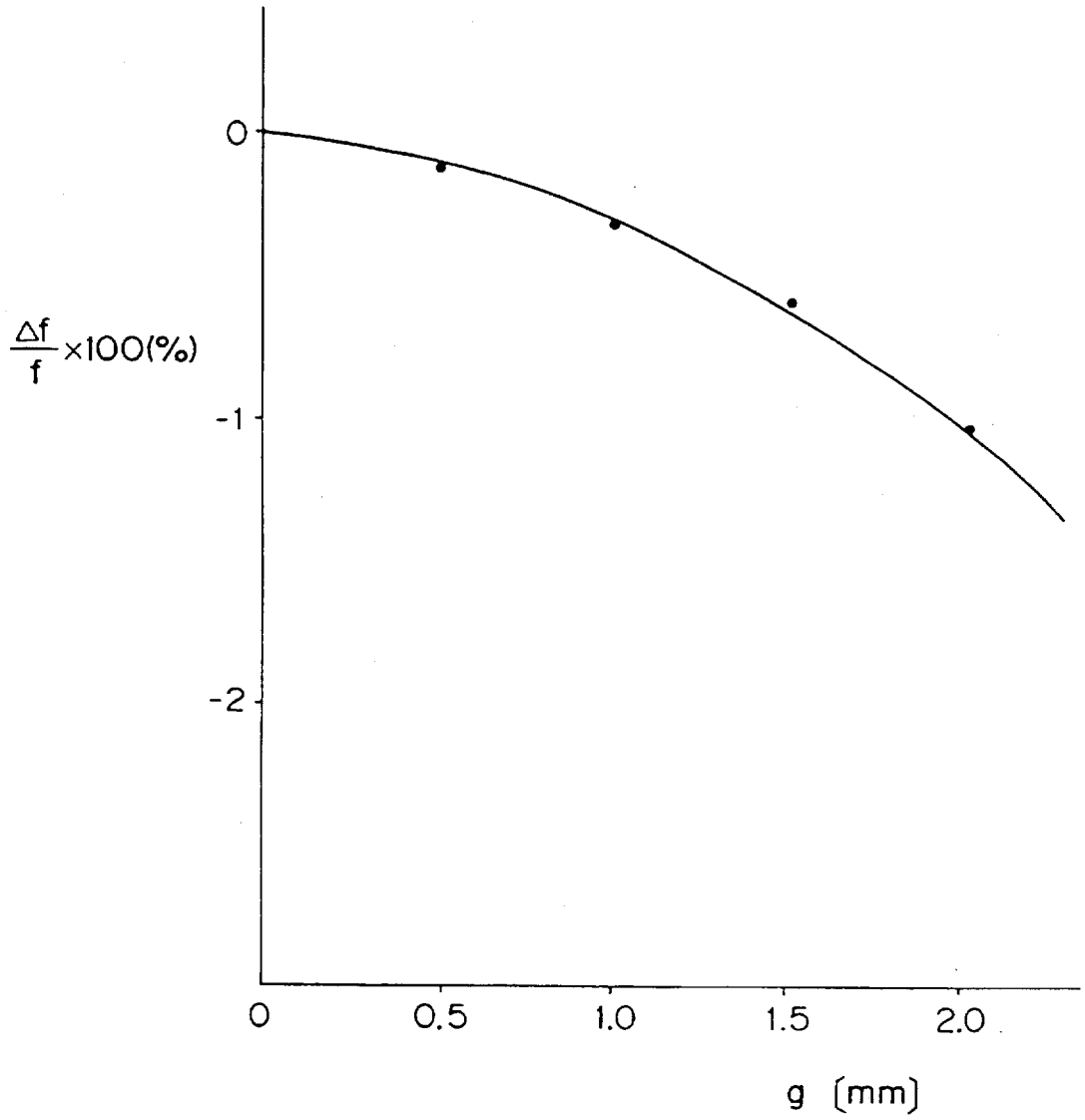
FIG. 12 is a graph showing the measurement result in the resonance frequency changes of the dielectric resonator in accordance with the third embodiment.

The construction of a dielectric resonator in accordance with a third embodiment where the resonance frequency and the coupling degree have been adjusted by the provision of a non-formed portion of the conductor and the dielectric in one portion of the short-circuit face, is shown in FIG. 8. FIG. 8 is a front face view seen from the short-circuit face side, with reference characters C, D being non-formed portions of the conductor and the dielectric of the short-circuit face. The resonance frequency of the resonator by the internal conductor formed hole 5 is lowered by the partial deletion of the conductor and the dielectric in the region of SI in FIG. 8. Similarly, if the conductor and the dielectric are partially deleted in the region of S2, the resonance frequency of the resonator is lowered by the internal conductor formed hole 6. The coupling degree between both the resonators is lowered if the conductor and the dielectric are partially deleted in the region of S12. Modified embodiments of the coupling coefficients by the deletion of the conductor and the dielectric are shown in FIG. 9 and FIG. 11. A conductor deletion portion of a width d is provided in a middle position from the two coupling holes, as shown in FIG. 9. Changes in the coupling coefficients are measured when the conductor deletion area S is changed. In FIG. 9, a=2.0 mm, b=4.0 mm, c=5.0 mm. FIG. 11 shows the change ratio of the coupling coefficients with the axis of abscissas being a conductor deletion area S, and the axis of ordinates being the ratio of change in the coupling coefficients with Ko the coupling coefficient in the case of S=0 and Ka the coupling coefficient after the conductor deletion. The coupling coefficient can be adjusted by adjusting the conductor deletion area among the internal conductor formed holes on the short-circuit face. FIG. 10 and FIG. 11 show an adjustment example of the resonance frequency. A conductor deletion portion of a length g with a width f is provided, in a location spaced away at a given distance from the internal conductor formed hole, as shown in FIG. 10, so as to measure the resonance frequency when the length g is changed. In FIG. 10, a=2.0 mm, e=3.0 mm, f=0.5 mm. In FIG. 12, the axis of abscissas is the length g of the conductor deletion portion, and the axis of ordinates shows the variation amount in the resonance frequency with the resonance frequency in the case of g=0 being a reference. Accordingly, the resonance frequency can be adjusted by adjusting the conductor deletion portion of the internal conductor formed periphery on the short-circuit face.

(Fourth Embodiment)

Figure 13:
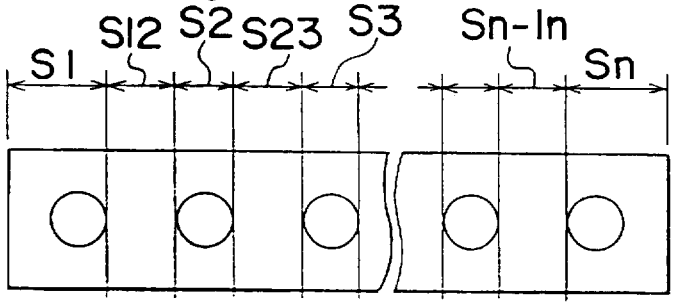
FIG. 13 is a front face view of a dielectric resonator in accordance with a fourth embodiment.

A fourth embodiment, also shown in FIG. 8 through FIG. 12 and further in FIG. 13 is that portions of the conductor and the dielectric are deleted on the short-circuit face, and the capacity Cs is thereby decreased. Moreover, the conductor and the dielectric on the other face, on the internal conductor non-formed portion side, are also deleted, so that the resonance frequency can be adjusted in a higher direction.

Although two stages of dielectric resonator are shown in the examples shown in FIG. 8 through FIG. 12, the same features can be applied even to a dielectric resonator of three stages or more. The coupling degree between the resonators are adjusted by the partial deletion of the conductor and the dielectric in the areas S12, S23, . . . $S_{n-1\ n}$ among the openings of the internal conductor formed holes on the short-circuit face as shown in FIG. 13. The resonance frequency of the respective resonators can be adjusted by the partial deletion of the conductor and the dielectric in the regions of S1, S2, S3 . . . Sn, shown in FIG. 13.

(Fifth Embodiment)

Figure 14:
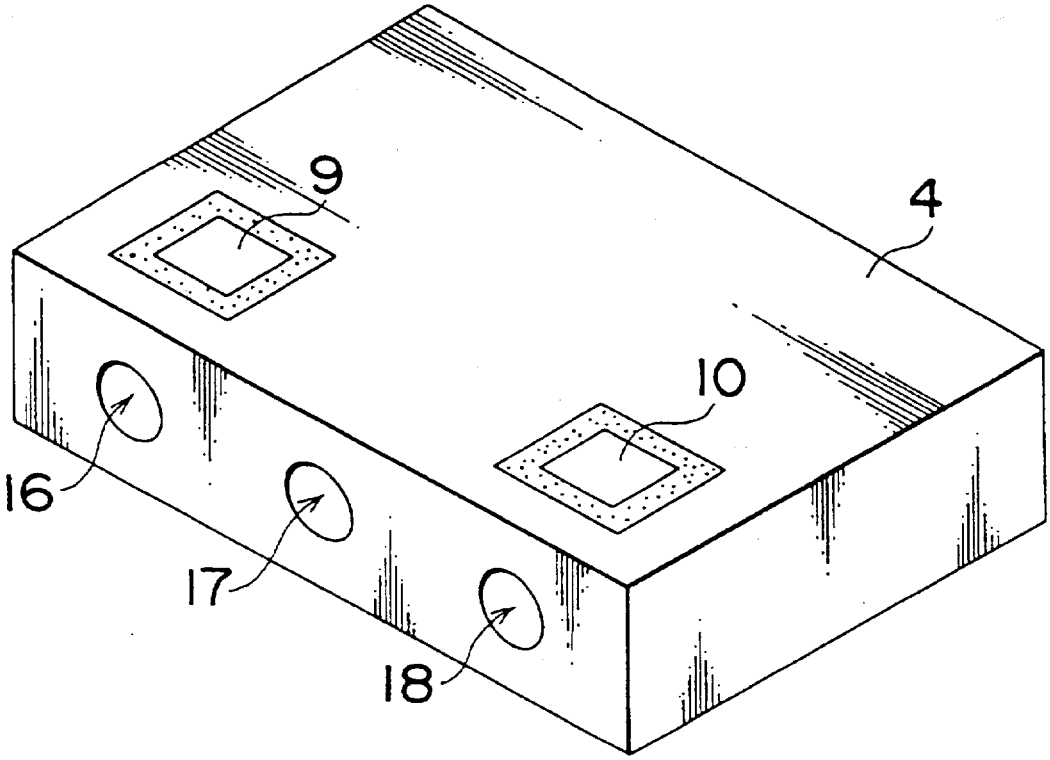
FIG. 14 is a perspective view of a dielectric resonator in accordance with a fifth embodiment.

The construction of a dielectric resonator in a fifth embodiment, which is different in the shape of the signal input, output electrodes, is shown in FIG. 14, which is a perspective view. In FIG. 14, reference numerals 16, 17, 18 are internal conductor formed holes with the internal conductor and the open portions thereof being formed on the inside surfaces of the holes 16, 17, 18. External conductor 4 is provided on the outside face of the dielectric block, with the signal input, output electrodes 9, 10 being formed only on the top face as shown in the drawing. The electrode 9 is coupled in capacity to the internal conductor within the internal conductor formed hole 16, and the electrode 10 is coupled in capacity to the internal conductor within the internal conductor formed hole 18. When the dielectric resonator is mounted on a circuit basic plate, the top face as shown in the drawing is positioned so as to be opposed to the mounting surface of the circuit basic plate.

(Sixth Embodiment)

The construction of a dielectric resonator and its characteristic adjusting method thereof in accordance with a sixth embodiment will be described hereinafter with reference to FIG. 15 through FIG. 19.

Figure 15:
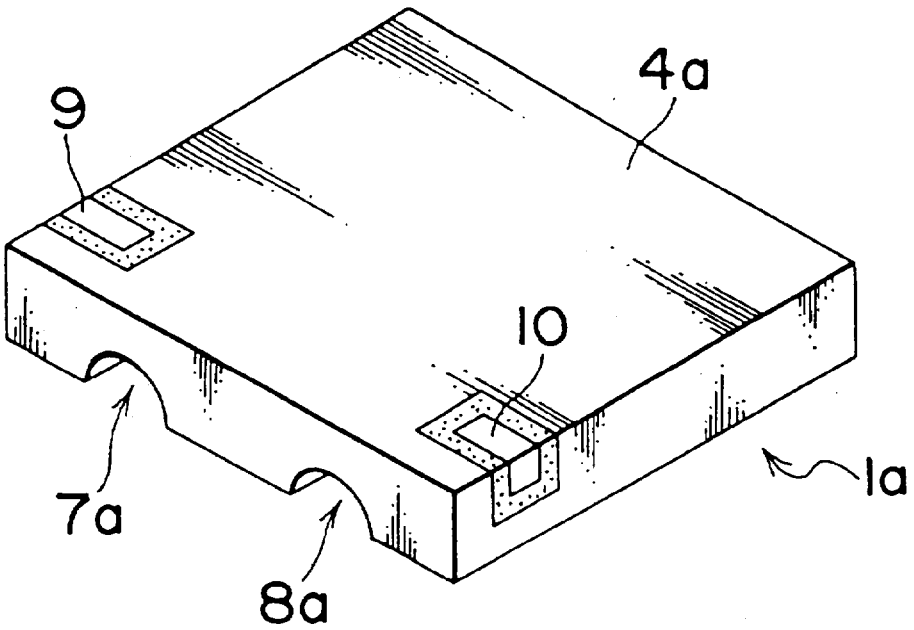
FIG. 15 is an exploded perspective view of a dielectric resonator in accordance with a sixth embodiment.
Figure 15:
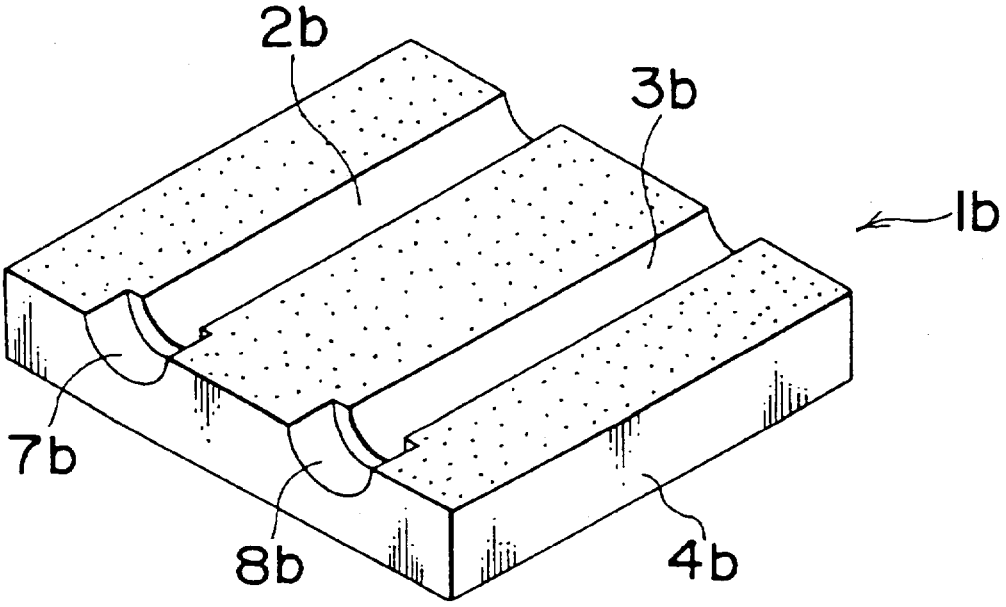

FIG. 15 is an exploded perspective view of the dielectric resonator. In FIG. 15, reference numerals 1*a*, 1*b* are, respectively, dielectric basic plates. Two semicircular grooves are formed, respectively, on one main face of each dielectric basic plates 1*a*, 1*b* and the internal conductor is formed on inside faces thereof. Reference numerals 2b, 3b are internal conductors provided on the inside of the grooves of the dielectric basic plate 1b. Hollowed out portions or hollows 7a, 8a and 7b, 8b are formed at ends of the grooves of the dielectric basic plates 1a, 1b, respectively. An external conductor 4a is provided on the other main face, opposite to the internal conductor formed main face, and the four side faces of the dielectric basic plate 1a and an external conductor 4b is similarly provided on the other main face, opposite to the internal conductor formed face, and the four side faces of the dielectric basic plate 1b. Signal input, output electrodes 9, 10 are formed in the external conductor 4a of the dielectric basic plate 1a, as shown in FIG. 15.

Figure 16:
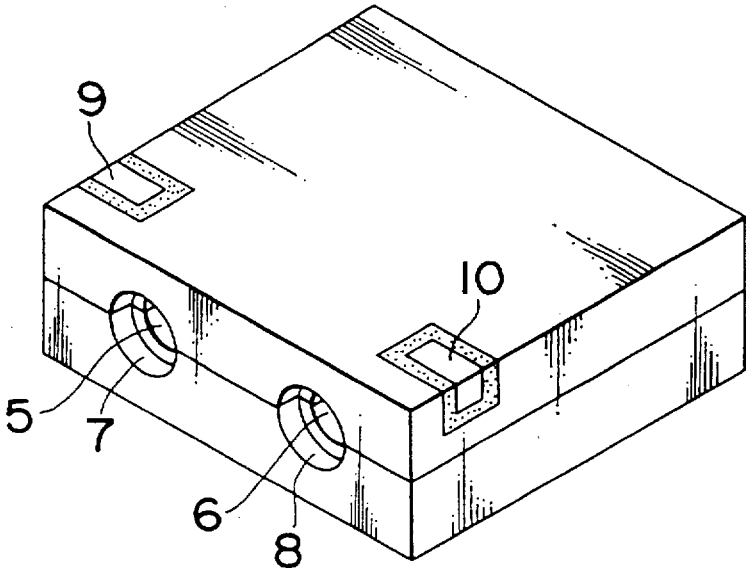
FIG. 16 is a perspective view of the dielectric resonator in accordance with the sixth embodiment.

FIG. 16 shows a dielectric resonator before characteristic adjustment, with the two dielectric basic plates 1a, 1b, shown in FIG. 15, being connected with the internal conductors formed therein placed in opposing positions to each other. Circular shaped internal conductor formed holes 5, 6 are constructed by the combination of the semi-circular shaped grooves shown in FIG. 15. The step shaped hollows 7, 8 shown are constructed by the combination of the hollows 7a, 7b and 8a, 8b formed on the dielectric basic plates 1a, 1b. The dielectric resonator, shown in FIG. 16, is mounted after characteristic adjustment with the top face shown in the drawing being in contact against the basic plate.

Figure 17:
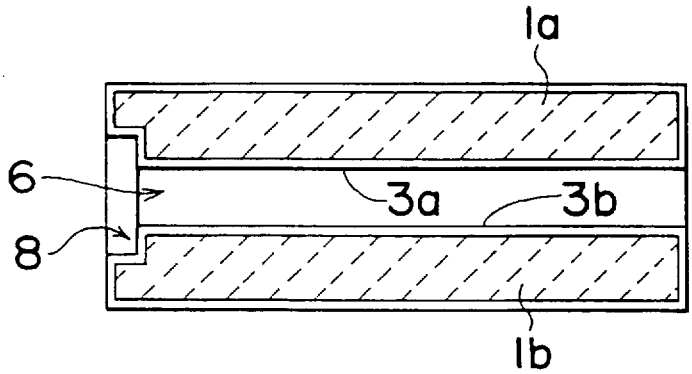
FIG. 17 is a sectional view of the dielectric resonator in accordance with the sixth embodiment.

FIG. 17 is a sectional view through the internal conductor formed hole 6 of the dielectric resonator shown in FIG. 16.

Lines on the connection face of the dielectric basic plate have been omitted (the views for reference are also the same in the subsequent description) so as to avoid complicated views.

Figure 18:
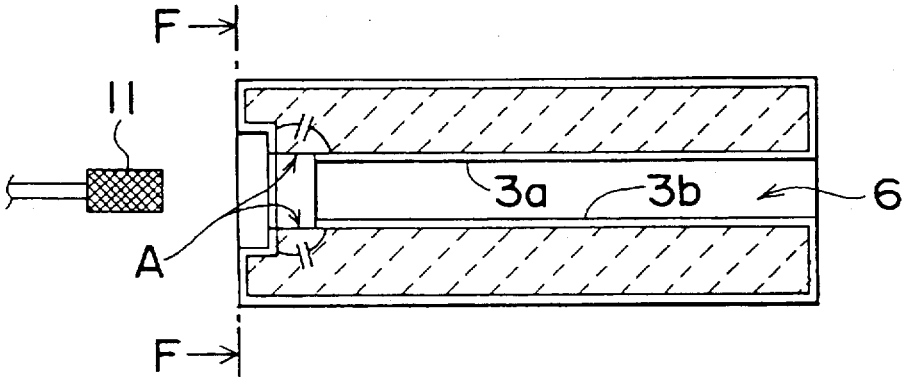
FIG. 18 is another sectional view of the dielectric resonator in accordance with the sixth embodiment.
Figure 19:
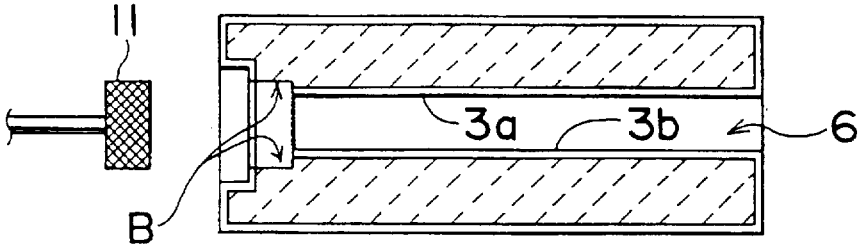
FIG. 19 is yet another sectional view of the dielectric resonator in accordance with the sixth embodiment.

FIG. 18 and FIG. 19 are two embodiments where an open portion is formed in one portion of the internal conductor and the resonator characteristics are thereby adjusted. In FIG. 18, reference character A shows locations where the respective one-portions of internal conductors 3a, 3b are deleted near the hollow formed portions. More specifically, grinding tools such as Ryta with a grindstone, shaped as shown by reference numeral 11, being mounted thereon are used. The deleted portion is made into an open portion with one portion of the internal conductor being removed by the use of the grinding tool. As the deleted portion A of the internal conductor is formed in a location spaced away from the open face F as shown in FIG. 18, electromagnetic field leakage is prevented with respect to the interior from the open face F and the resonator is hardly influenced by electromagnetic field at the resonator periphery. If a metallic unit is located near the open face F, the characteristics of the resonator are not disturbed by influences from the metallic unit. When the adjusting operation is conducted with the use of a grinding tool as shown in FIG. 18, the amount of the internal conductors 3a, 3b removed is controlled by the insertion depth of the grinding tool so that the tip end capacity can be easily adjusted. As the resonator frequency and the coupling degree of its adjacent resonators change if the tip end capacity changes, the desired resonator characteristics are obtained by adjusting the insertion depth of the grinding tool with respect to the internal conductor formed hole. As shown in FIG. 18, the tip end capacity, which is to be formed in the open portion of the internal conductor, is large so that the coupling degree between the resonators is made large so as to easily make the band broader.

FIG. 19 shows an other adjustment characteristic method. In FIG. 19, reference character B shows locations where the dielectric has been removed together with the internal conductor near the hollow portion formed near one opening of the internal conductor formed hole 6. A grinding tool 11, which is provided with a grindstone having a scoop diameter larger than the inside diameter of the internal conductor formed hole, is used so as to grind the dielectric together with the internal conductor. Accordingly, the grinding tool is inserted in an axial direction from the hollow formed portion with the grinding tool being set to the center of the bore of the internal conductor formed hole so that the dielectric together with the internal conductor can be easily ground and removed by a fixed amount.

(Seventh Embodiment)

Figure 20:
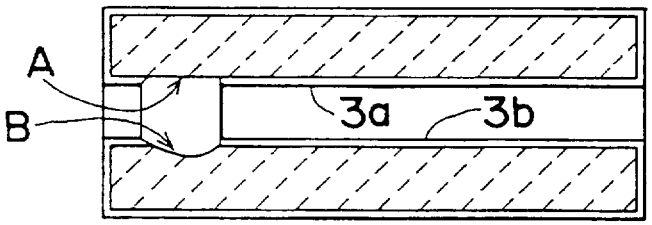
FIG. 20 is a sectional view of a dielectric resonator in accordance with a seventh embodiment.

FIG. 20 shows a sectional view of a dielectric resonator in accordance with a seventh embodiment. In FIG. 20, reference characters A, B show the locations of deleted portion of the internal conductors. One portion of the internal conductor is ground, near the opening of the internal conductor formed hole, in a location spaced away from the opening face, so that the open portion of the internal conductor is formed at a location spaced away from the open face of the dielectric resonator. Accordingly, the problem caused by electromagnetic field leakage is removed. A grinding tool, provided with a grindstone of comparatively small diameter, is used for formation and adjustment of such an open portion so that an inserting operation and a boring operation can be effected obliquely from the open portion. At this time, one portion of the dielectric is also ground, as shown by letter B in FIG. 20 and the tip end capacity can be adjusted by the depth thereof.

(Eighth Embodiment)

The construction of a dielectric resonator and its characteristic adjusting method in an eighth embodiment will be described hereinafter in accordance with FIG. 21 and FIG. 22.

Figure 21:
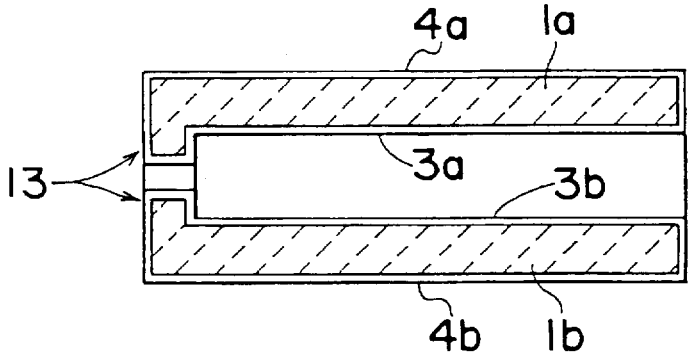
FIG. 21 is a sectional view of a dielectric resonator in accordance with an eighth embodiment.

FIG. 21 is a sectional view through an internal conductor formed hole portion of the dielectric resonator. The basic construction is different from the sixth embodiment although it is almost similar to the construction of FIG. 15 and FIG. 16. A narrowed throttle portion 13 is formed at one opening of the internal conductor formed hole. Internal conductors 3a, 3b are formed on the inside surface of the internal conductor formed hole and external conductors 4a, 4b are provided on the outside surface of the dielectric resonator, as shown in FIG. 21. A conductor film, which is continuous to the external conductor from the internal conductor, is formed on the inside surface of the throttle portion 13.

Figure 22:
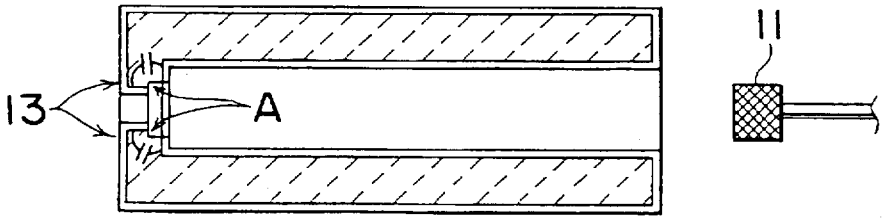
FIG. 22 is a sectional view of the dielectric resonator in accordance with the eighth embodiment.
Figure 23:
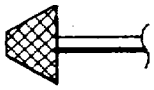
FIG. 23 is a view showing the shape of a grindstone.
Figure 24:
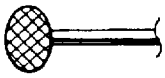
FIG. 24 is a view showing the shape of another grindstone.

FIG. 22 is a view showing an example of the formation of an open portion and an adjusting method. In FIG. 22, reference character A shows the locations of the deleted portions of the internal conductor and the dielectric. One portion of the internal conductor is deleted on the internal conductor formed hole side of the throttled portion 13 whereby the open portion of the internal conductor is formed in a location spaced away from the open face. Therefore, electromagnetic field leakage is restrained. In order to form such an open portion, so as to effect the characteristic adjustment, a grindstone of Ryta is inserted from an opening of the internal conductor formed hole where the throttle portion 13 is not formed into the internal conductor formed hole so as to adjust the grinding amount by the insertion depth thereof, as shown in FIG. 22. The change proportion of change of the tip end capacity with respect to the insertion amount of the grindstone is dependent on the tip end shape of the grindstone. A grindstone shaped as shown in FIG. 23 and FIG. 24 may be used considering the desired and accuracy of the characteristic adjustment.

(Ninth Embodiment)

The construction and adjustment method of a dielectric resonator in accordance with a ninth embodiment will be described hereinafter in accordance with FIG. 25 through FIG. 27.

Figure 25:
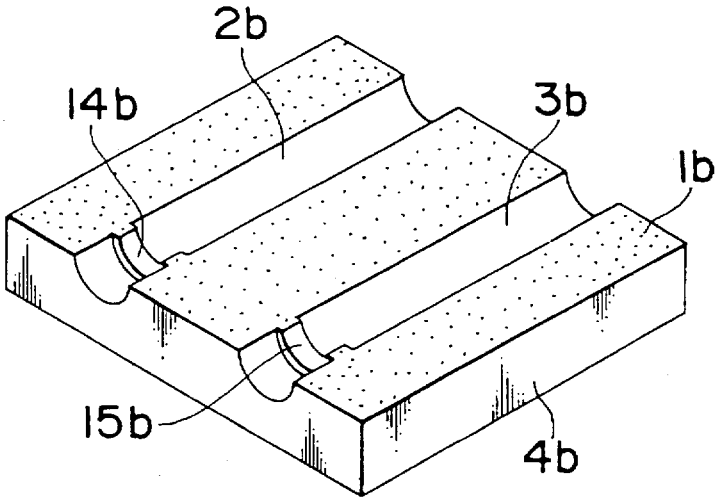
FIG. 25 is a perspective view of one dielectric basic plate for constituting the dielectric resonator in accordance with a ninth embodiment.

FIG. 25 shows one basic plate for forming a dielectric resonator. In FIG. 25, reference character 1*b* is a dielectric basic plate. Two semicircular (sectional) grooves are formed on one main face of the dielectric basic plate 1*b* with internal conductors 2*b*, 3*b* being formed on the inside faces thereof. Semicircular sectional portions 14*b*, 15*b* of the throttle portion are formed in one portion of each groove. An external conductor 4*b* is formed on the other main face, opposite to the internal conductor, and the four side faces of the dielectric basic plate 1*b*. A dielectric resonator is formed with two basic plates, which are shaped the same as the basic plate shown in FIG. 25 being connected opposite to each other.

Figure 26:
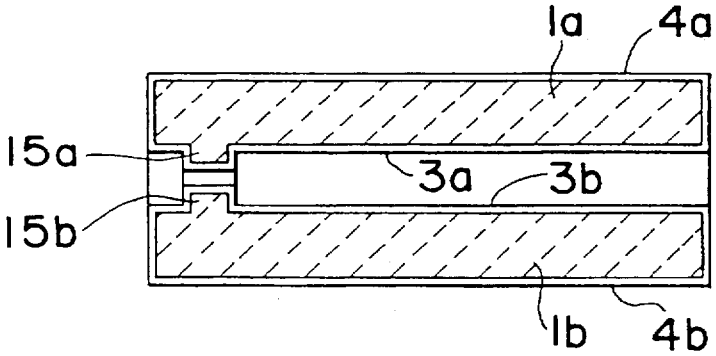
FIG. 26 is a sectional view of the dielectric resonator of the ninth embodiment.
Figure 27:
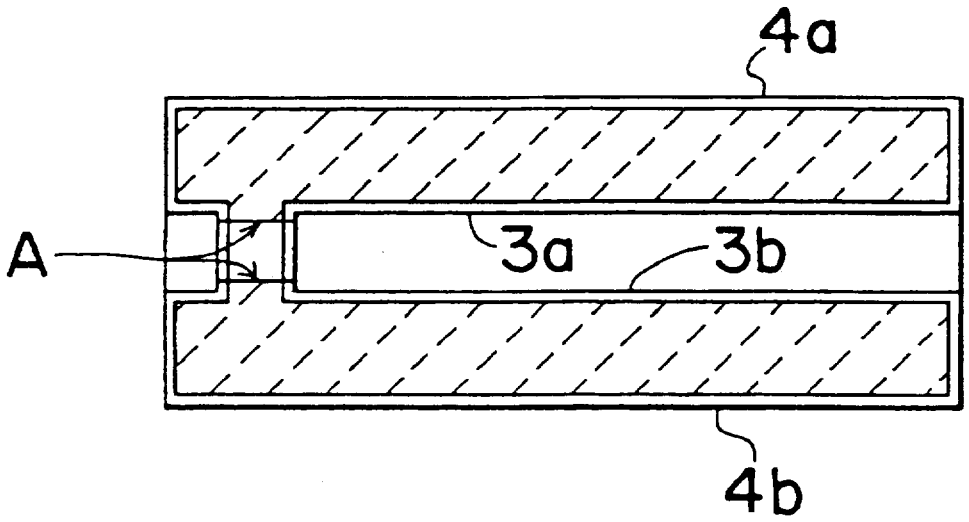
FIG. 27 is a sectional view of the dielectric resonator in accordance with the ninth embodiment.

FIG. 26 is a sectional view thereof. In FIG. 26, reference numerals 15*a*, 15*b* indicate a throttle portion formed in one portion of the internal conductor formed hole. In a dielectric resonator having such a narrower or throttle portion in one portion of an internal conductor formed hole, an internal conductor formed on the inside surface of the throttle portion is removed with the use of a grinding tool or the like, near one opening of the internal conductor formed hole, as shown in FIG. 27, so as to form an open portion in the internal conductor and effect a characteristic adjustment. In FIG. 27, reference character A shows the deleted portions hereof. In this manner, electromagnetic field leakage is restrained by forming the open portion of the internal conductor in a location spaced away from the open face of the dielectric resonator. The adjusting operation is simplified, and the adjusting accuracy is also improved, as the grinding range for the grinding tool is restricted to the throttle portion. Although the sixth through the ninth embodiments each have two dielectric basic plates superposed in the embodiment, the construction and the characteristic adjustment method of the sixth through the ninth embodiment can be applied in the same manner even to an integral type dielectric resonator with an internal conductor formed hole being provided in a single dielectric block as in the first through the fifth embodiments. The construction and characteristic adjustment method of the first through the fifth embodiments can have two dielectric basic plates superposed as in the sixth through the ninth embodiments, and can be applied in the same manner even to the dielectric resonator with the internal conductor formed holes being provided therein.

Although the present embodiments have a comb line-type of dielectric resonator as an example, even an interdigital type can be similarly applied.

(Tenth Embodiment)

Figure 28A:
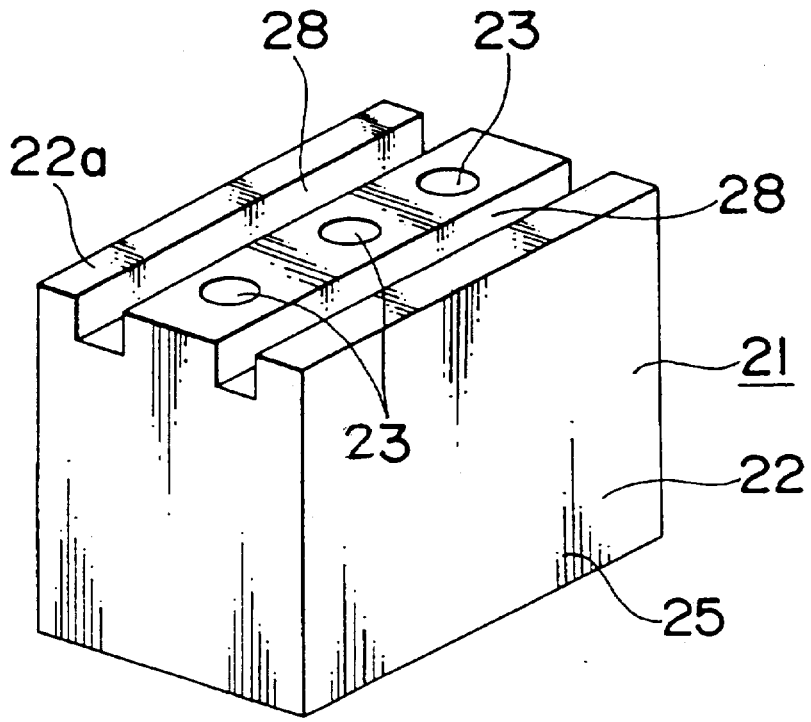
FIGS. 28 (*a*) and (*b*) are a perspective view and a sectional view respectively, of a dielectric resonator in a tenth embodiment of the present invention.
Figure 28B:
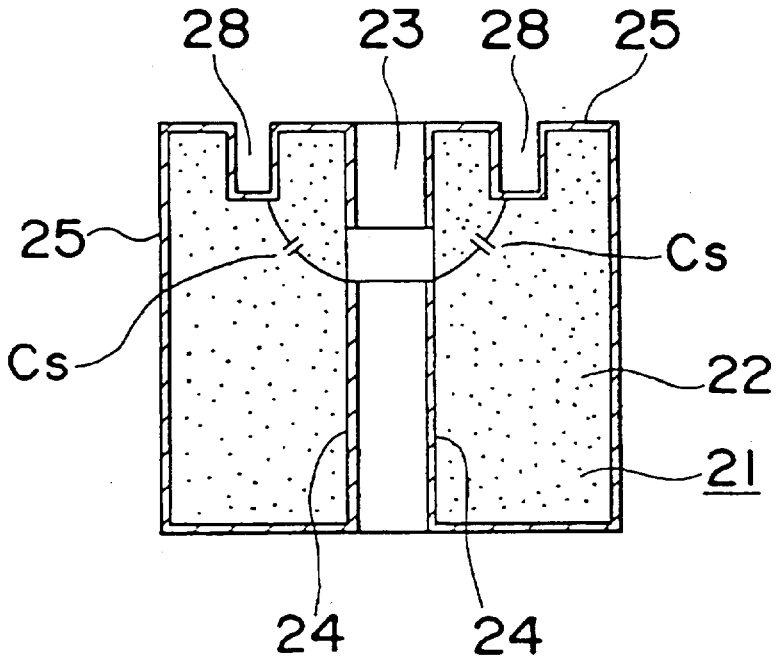

FIG. 28 (*a*) shows a tenth embodiment. Slot-like portions 28 are formed in the dielectric body with the inside of the slots being approximately parallel with the end face 22*a* side of the dielectric 22. The portions 28 are formed on both the sides of the holes 23 which have an inside conductor 24 of the dielectric 22 formed on the inside surface. An outside conductor 25 is formed across the entire outside surface of the dielectric 22, including the slot portion 28. Accordingly, the distance between the outside conductor 25, which becomes an earth electrode for the bottom portions of the slot portions 28, and the inside conductor 24 becomes shorter as shown in FIG. 28 (*b*), so that floating capacity Cs can be easily obtained.

The slot portion 28 can be worked into the dielectric 22 or formed in it by a molding operation. Accordingly, the floating capacity Cs can be obtained by a comparatively simple working operation or the molding operation. The adjustment of the floating capacity Cs (size of the floating capacity Cs) can be easily effected by variation of the size and the depth of the slot portion 28 or by removing one portion of the outside conductor 25.

In the comb-line type filter, the band width of the filter can be made larger by provision of, for example, a larger floating capacity Cs. The resonator length becomes shorter and the size can be made smaller by provision of, for example, the larger floating capacity Cs. Further, the floating capacity Cs can be easily obtained, and also, the adjustment of the floating capacity Cs can be easily effected even in a filter having the construction of interdigital coupling.

(Eleventh Embodiment)

Figure 29:
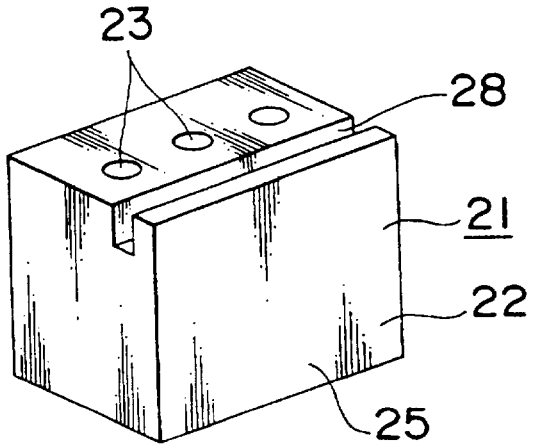
FIG. 29 is a perspective view of a dielectric resonator of an eleventh embodiment of the present invention.

FIG. 29 shows an eleventh embodiment, which is different from the previous embodiment, with a single slot-like portion 28 being provided on one side of the dielectric 22. Even in this embodiment, the floating capacity Cs can be easily obtained and the adjustment can be easily effected as in the previous embodiment.

(Twelfth Embodiment)

Figure 30A:
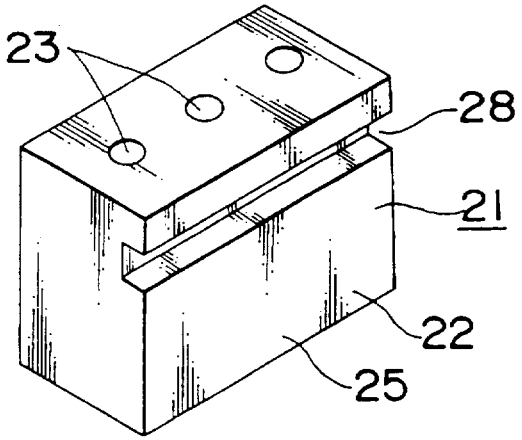
FIGS. 30 (*a*) and (*b*) are a perspective view and an essential portion sectional view, respectively of a dielectric resonator of a twelfth embodiment.
Figure 30B:
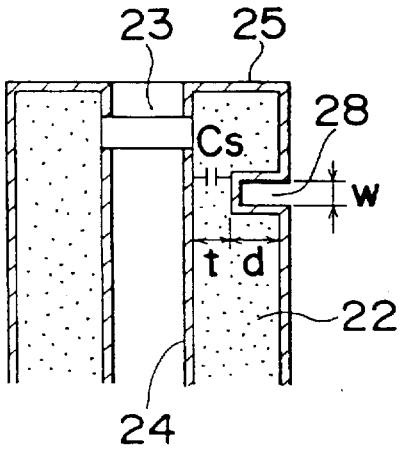

FIGS. 30 (*a*) and (*b*) show a twelfth embodiment. In this embodiment, the slot-like portion 28 is formed on one side face of the dielectric 22. The external conductor 25 at the bottom portion of the slot portion 28 is brought towards the inside conductor 24, which is formed within the hole 23 of the dielectric 22, so as to easily obtain the floating capacity Cs.

The interval t between the outside conductor 25, which becomes an earth electrode and the inside conductor 24, the width w and the depth d of the slot portion 28 and so on may be changed so as to control the floating capacity Cs.

The coupling between the resonators can be adjusted by the adjustment of the floating capacity Cs. The passing zone of the filter can be controlled without changes. The above described floating capacity Cs can be made larger by adjusting the slot portion 28.

The shape of the dielectric resonator can be standardized, the metal mold cost and the management cost can be reduced. In the embodiment shown in FIGS. 30 (*a*) and (*b*), the slot portion 28, which is formed on one side face of the dielectric 22, may be formed on both the side faces of the dielectric 22. In this case, the floating capacity Cs can be made even.

(Thirteenth Embodiment)

Figure 31:
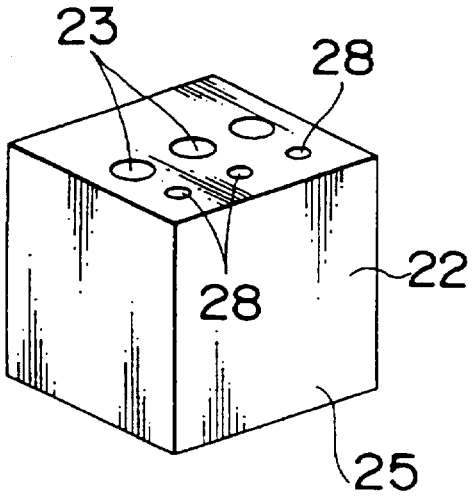
FIGS. 31 (*a*) and (*b*) are a perspective view and an essential portion sectional view, respectively of a dielectric resonator of a thirteenth embodiment.
Figure 31:
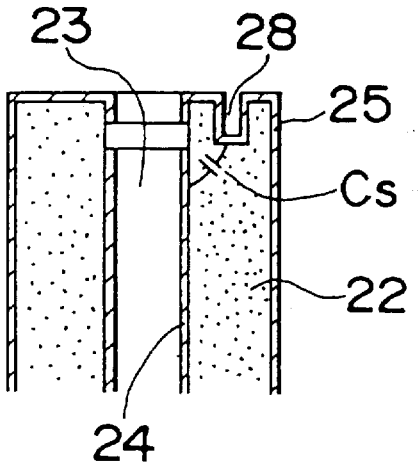

FIGS. 31 (*a*) and (*b*) show a thirteenth embodiment. Round hole shaped portions 28 are formed, in the same direction, near the holes 23. The hole portions 28 are respectively formed in accordance with the number of holes 23. The number of hole portions 28 formed may be one, or the hole portions 28 may be formed according to the number of the holes 23 or more. The hole portions 28 may be provided correspondingly on both the sides of the holes 23. Many hole portions 28 may be formed.

(Fourteenth Embodiment)

Figure 32:
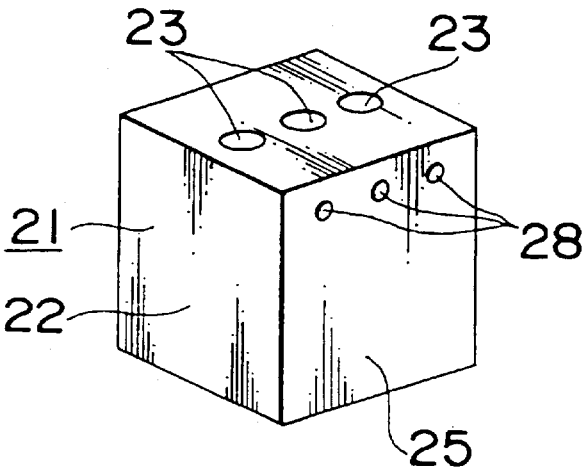
FIGS. 32 (*a*) and (*b*) are a perspective view and an essential portion sectional view, respectively of a dielectric resonator of a fourteenth embodiment.
Figure 32:
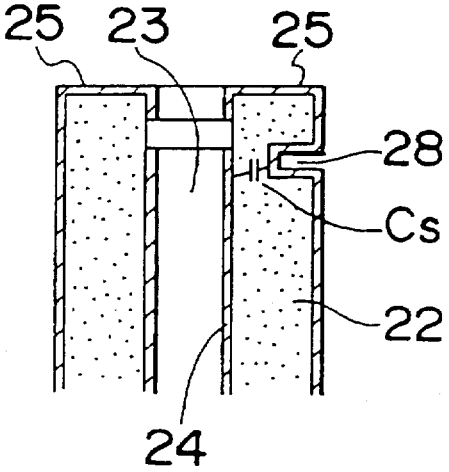

FIGS. 32 (*a*) and (*b*) show a fourteenth embodiment. In this embodiment, the round hole shaped portions 28 are formed on the side face of the dielectric 22. The external conductor 25 at the bottom portion of the hole portions 28 is brought near in parallel to the internal conductor 24. Even in this embodiment, the hole portions 28 are formed so as to correspond to the holes 23. The number of the hole portions 28 may be one or may be three or more. In addition, the hole portions 28 may be formed in either face of the dielectric 22.

(Fifteenth Embodiment)

Figure 33A:
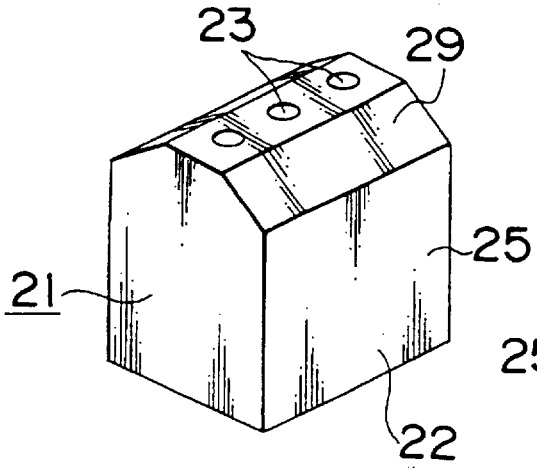
FIGS. 33 (*a*) and (*b*) are a perspective view and an essential portion sectional view, respectively of a dielectric resonator of a fifteenth embodiment of the present invention.
Figure 33B:
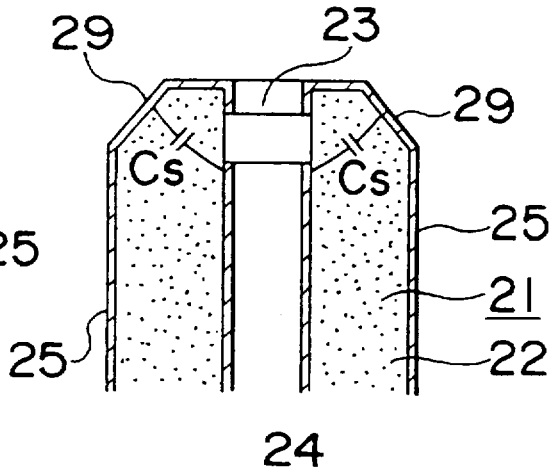

FIGS. 33 (*a*) and (*b*) show a fifteenth embodiment. Slope-like or taper potions 29 are formed on both the corner portions of the open face 23 of the dielectric 22, as shown in FIG. 33 (*a*). The taper portions 29 are formed so that the distance between the internal conductor 24, within the hole 23, and the external conductor 25, which serves as an earth electrode of the taper portions 29 is reduced, and the floating capacity Cs can therefore be easily obtained as in the above described embodiments.

The size of the floating capacity Cs can be easily adjusted by the slope or the angle of the taper portions 29 and the size of the taper portions 29. The taper portion 29 is formed on the angle portion of the open face so that the floating capacity Cs may be obtained.

(Sixteenth Embodiment)

Figure 34:
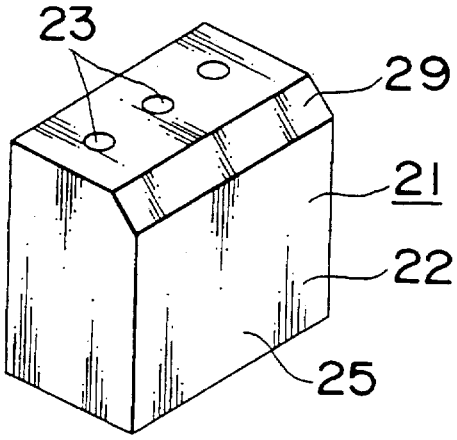
FIG. 34 is a perspective view of a dielectric resonator of a sixteenth embodiment thereof.

FIG. 34 shows a sixteenth embodiment where the taper portion 29 is formed on a single side of the dielectric 22. Even in this embodiment, the floating capacity Cs can be easily obtained by the taper portion 29.

(Seventeenth Embodiment)

Figure 35:
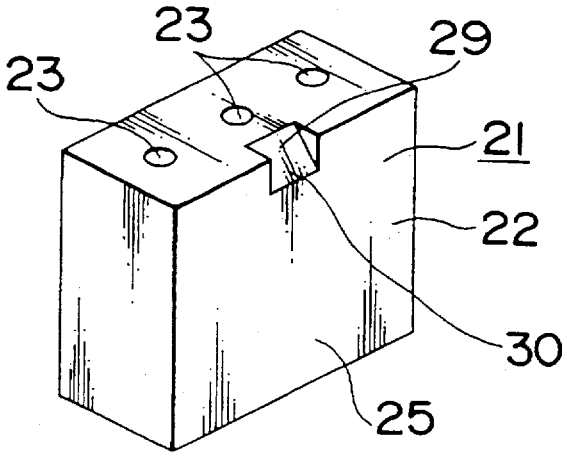
FIG. 35 is a perspective view of a dielectric resonator of a seventeenth embodiment thereof.

FIG. 35 shows a seventeenth embodiment. In the present embodiment, a smaller taper or slope portion 29 is formed in a limited portion instead of along the whole edge or corner of the dielectric 22 as shown in FIG. 35. In FIG. 35, a slotted portion 30 with a taper portion 29 being formed therein is formed on only one portion of the edge of the dielectric 22. Portions 30 may be formed in plurality on the single side or both the sides of the dielectric resonator in accordance with the respective holes 23. The number of the slotted portions 30 is not restricted.

The floating capacity Cs can be easily adjusted by the position and size of the slotted portions 30.

(Eighteenth Embodiment)

Figure 36:
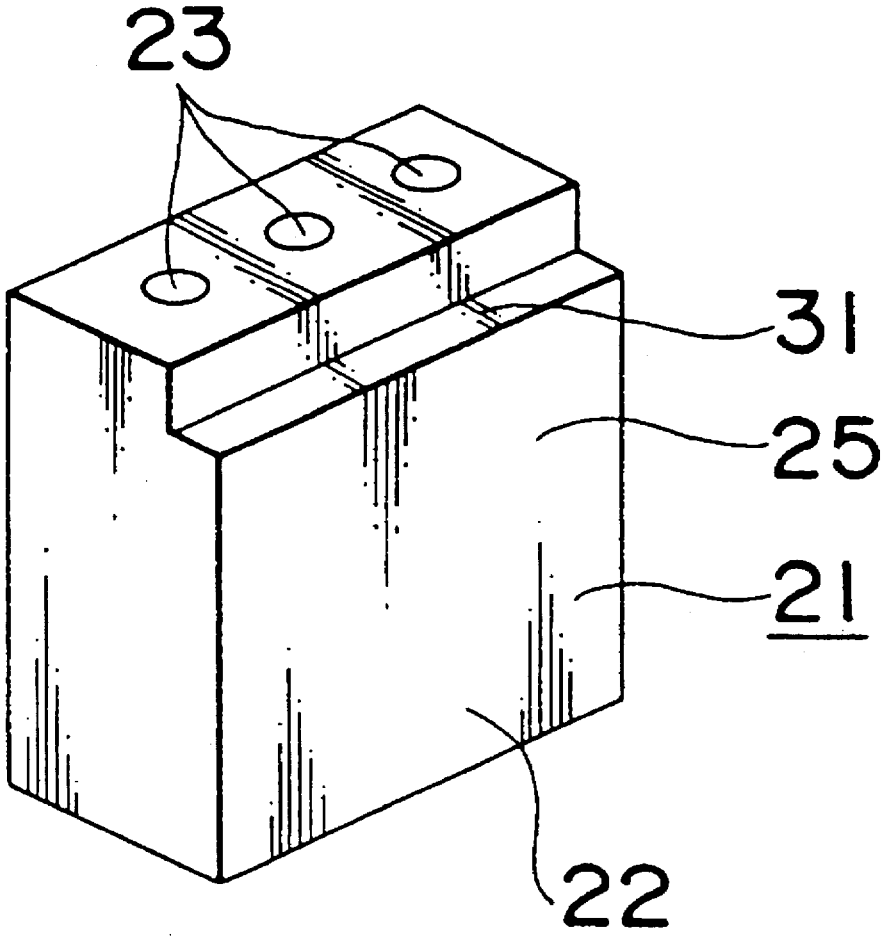
FIG. 36 is a perspective view of a dielectric resonator of an eighteenth embodiment of the present invention.

FIG. 36 is an eighteenth embodiment, where a stepped portion 31 of an approximately L-shape is formed, instead of the taper or slotted shaped section formed in the previous embodiments, on a corner portion of a single side on the top face of the dielectric 22. Even in this case, the distance between the inside conductor 24 within the hole 23 and the outside conductor 25, which becomes an earth electrode of the stepped portion 31 is reduced so that the floating capacity Cs can be easily obtained.

Although the stepped portion 31 is continuously formed along the edge, as shown in FIG. 36, it may be formed not continuously, in one portion or intermittent portions, and in the corner portions on both the side portions of the dielectric 22. The size of the floating capacity can be easily adjusted by the size and/or the number of the stepped portions 31.

(Nineteenth Embodiment)

Figure 37:
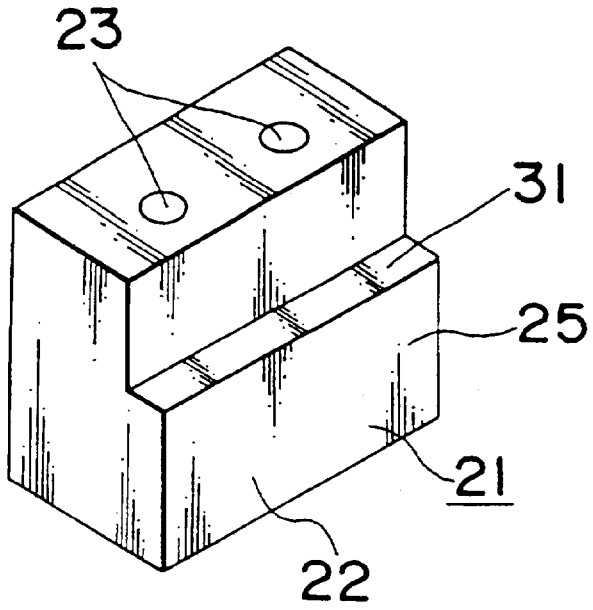
FIG. 37 is a perspective view of a dielectric resonator of a nineteenth embodiment thereof.
Figure 38:
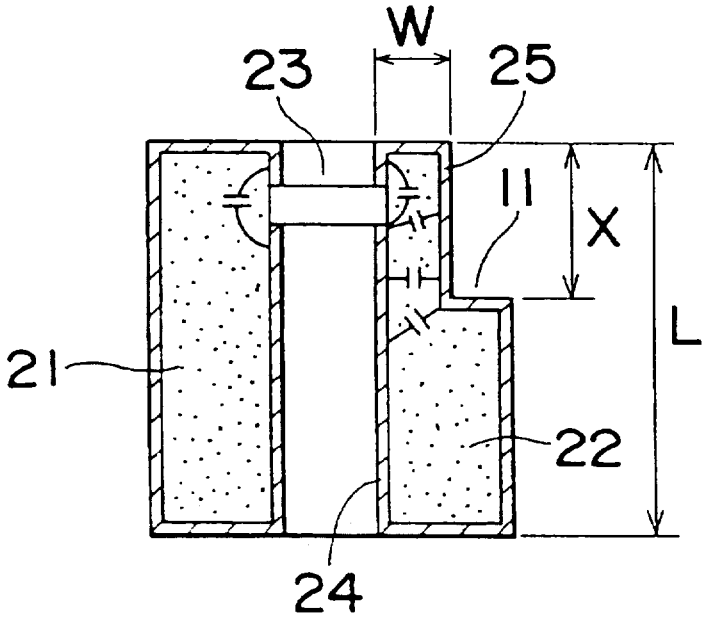
FIG. 38 is a sectional view of a dielectric resonator of a twentieth embodiment thereof.
Figure 39:
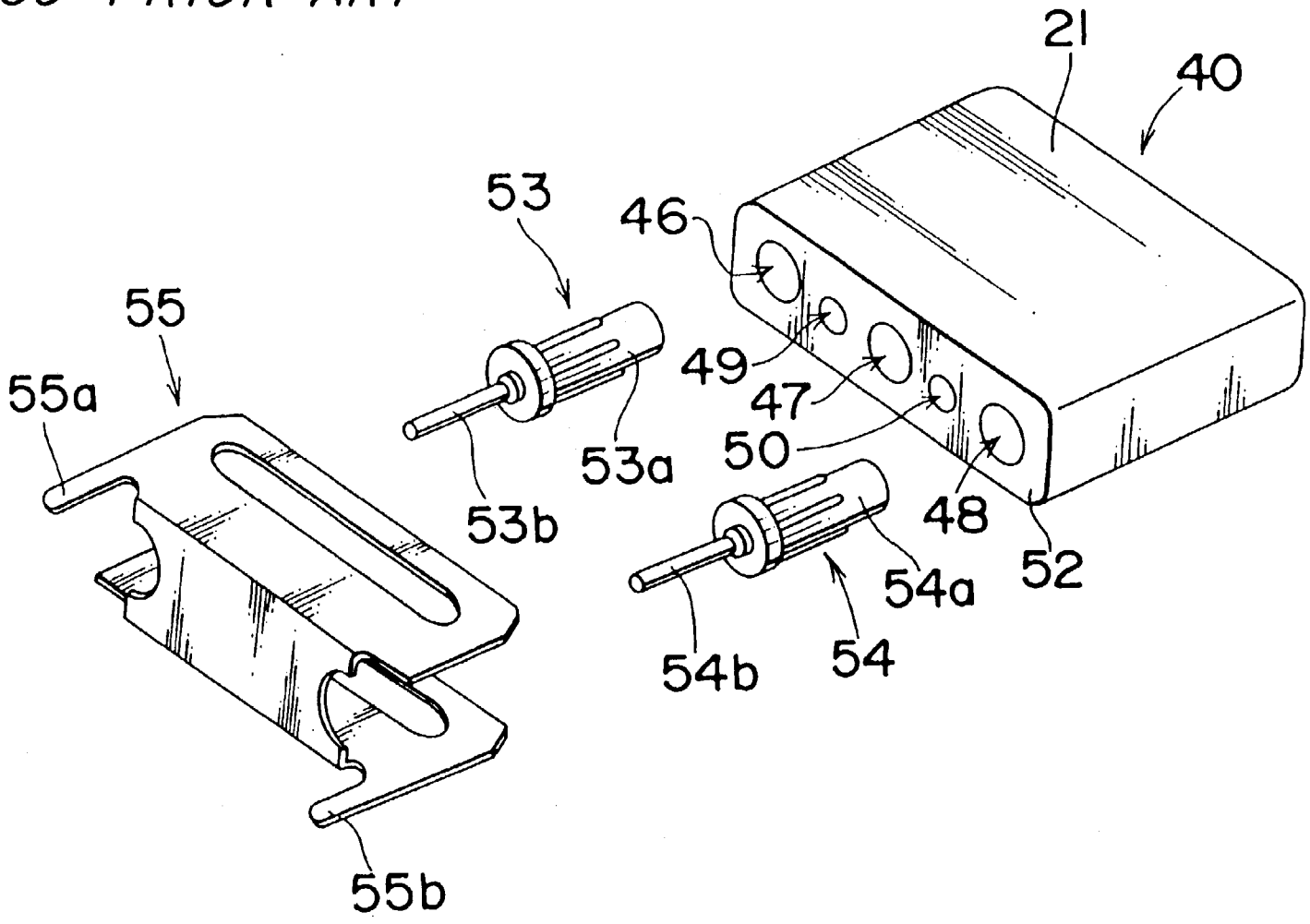
Fig. 39 PRIOR ART
FIG. 39 is an exploded perspective view of a conventional dielectric resonator.

The nineteenth embodiment, shown in FIG. 37, has a stepped portion 31 which is further deepened along the side of the dielectric resonator as compared with the case of the above described eighteenth embodiment. In an integrated type of dielectric resonator, the floating capacity Cs is obtained by the inside conductor 24, and the stepped portion 31 is formed in a dielectric filter which is comb-line connected so that the outside conductor 25 is brought closer to the inside conductor 24 within the hole 23 so as to increase the floating capacity Cs.

The approached size W and the depth X of the stepped portion 31 are adjusted so as to adjust the coupling. When the size of the dielectric 22 in the axial direction of the hole 23 is made L, $0 \leqq X < L$.

The coupling coefficients of the dielectric resonator can be changed by the change in the above described sizes X, W so that the passing band of the filter can be controlled without changing the overall shape of the dielectric resonator (metal mold).

The shape of the dielectric resonator can be therefore standardized, and the metallic cost and the management cost can be reduced.

As a large coupling coefficient can be obtained without the pitch between the holes 23 being narrowed, the pole of the high pass becomes far from the passing band, and the damping of the low pass is improved. The resonance electrode length becomes shorter with the floating capacity Cs being increased, so that the filter can be made smaller in size. Further, a larger filter in the specific band is obtained.

The dielectric resonator in each of the above described embodiments is not restricted to the number of the stages shown, although the three-stage construction has been described. Namely, it can be applied to a dielectric resonator of one stage or three-stage or more.

The dielectric resonator of the present invention can be applied to a case where all the filters such as band pass filter, band elimination filter, high-pass filter, low-pass filter and so on are formed.

As is clear from the foregoing description, according to the arrangement of the present invention, the dielectric resonator of the present invention can be mounted on the surface of a circuit basic plate without the use of special individual signal input, output terminals since the signal input, output electrodes are provided on the external conductor. Moreover, since the conductor is formed on the open face of the internal conductor formed hole so as to eliminate the open face, electromagnetic field leakage is reduced so that influence by the electromagnetic field leakage is less if the dielectric resonator is mounted on the circuit basic plate in a condition as it is.

According to the dielectric resonator of the present invention, coupling coefficients can be adjusted between the resonator frequency of the resonator and the resonance without coating addition and so on by the non-formed portion of the internal conductor.

According to the dielectric resonator of the present invention, the open portion of the internal conductor is formed in a location spaced away from the open face of the internal conductor formed holes, therefore, the influences by electromagnetic field leakage is lessened. Therefore, no couplings between the resonator, the other objects near the resonator and the circuit are provided so that stable resonator characteristics are provided.

As is clear from the characteristic adjusting method of the dielectric resonator of the present invention, there are steps of providing an open portion in one portion of the internal conductor only by the movement of a grinding tool in the axial direction of the internal conductor formed hole with the deletion locations of the internal conductor and the dielectric being restricted. Also, steps for easily adjusting the tip end capacity by the amount the grinding tool is moved. Further, a dielectric resonator having desired resonance frequency and coupling amount can be easily obtained without demanding higher accuracy in the grinding working operation, because the tip end capacity is only gradually lowered in spite of much grinding amount of the whole dielectric.

In a dielectric resonator for making resonant with the desired frequency by an inside conductor formed on the inside surface of the hole of the dielectric and an outside conductor formed on the outside surface of the above described dielectric, a concave or depressed portion is formed on the surface of the above described dielectric, the outside conductor of the bottom portion of the concave or depressed portion is brought closer to the above described inside conductor so that the distance between the inside conductor of the hole in the interior of the dielectric and the outside conductor, which becomes an earth electrode, is reduced so as to easily obtain the floating capacity by the approaching operation between the outside conductor at the bottom portion of the concave or depressed portion formed on the surface of the dielectric and the above described inside conductor. The floating capacity can be adjusted by a comparatively simple working or molding operation of the size, depth and so on of the concave or depressed portion. In the comb-line type, the band width of the filter can be made larger by provision of, for example, larger floating capacity. Resonator length becomes shorter by the provision of, for example, the larger floating capacity with an effect that the size may be made smaller.

In the present invention, a taper or sloped portion is formed in the corner portion of the dielectric, and the outside conductor of the taper or sloped portion is brought closer to the inside conductor, the distance between the inside conductor of the hole in the interior of the dielectric and the outside conductor, which becomes an earth electrode, is reduced as in the case of the previous embodiment described above so that the floating capacity is easier to obtain. The floating capacity can be adjusted by a comparatively simple working or molding operation of the size, inclination and so on of the taper or sloped portion of the corner portion. In the comb-line type, the band width of the filter can be made larger by the provision of, for example, the larger floating capacity. The resonator length becomes shorter by provision of, for example, the larger floating capacity so that the size may be made smaller.

In the present invention, an approximately L type of stepped portion in section is provided in the corner portion of the dielectric, and the outside conductor of the stepped portion is brought closer to the inside conductor so that the distance between the inside conductor of the hole in the interior of the dielectric and the outside conductor, which becomes an earth electrode, is reduced so as to easily obtain the floating capacity. The floating capacity can be adjusted by a comparatively simple working or molding operation of the size, depth and so on of the stepped portion of the corner portion. In the comb-line type, the band width of the filter can be widened by provision of, for example, the larger floating capacity. The resonator length becomes shorter by provision of, for example, the larger floating capacity so that the size may be made smaller.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric filter with surface electromagnetic shielding, comprising:

a dielectric body having an outer surface;

an external conductor substantially completely covering the outer surface of the dielectric body so as to provide said surface electromagnetic shielding of said dielectric filter; and a plurality of holes extending through the dielectric body, each hole having a respective inner surface with a substantially constant cross-section shape along an axial direction of the corresponding hole;

at least one hole of said plurality of holes having a respective pair of internal conductors provided in the corresponding hole and conductively connected to said external conductor at respective ends of said corresponding hole, a respective non-conductive portion at said inner surface of the corresponding hole being spaced from both ends of said corresponding hole and thereby separating said corresponding pair of internal conductors and defining a respective capacitance between said corresponding pair of internal conductors, a surface of said respective non-conductive portion being substantially flush with the rest of said inner surface of the corresponding hole; and signal input and output electrodes provided on the outer surface of the dielectric body and electrically isolated from said external conductor for providing capacitive coupling with respective internal conductors of two of the plurality of holes, and closely surrounded by said external conductor for providing capacitive coupling with said external conductor;

wherein the dielectric body includes end faces corresponding to said ends of said holes, a recess being disposed in the dielectric body in one of said end faces of the dielectric body.

2. The dielectric filter as claimed in claim 1, wherein said recess extends across said end face adjacent to each one of said plurality of holes.

3. A dielectric filter with surface electromagnetic shielding, comprising:

a dielectric body having an outer surface;

an external conductor substantially completely covering the outer surface of the dielectric body so as to provide said surface electromagnetic shielding of said dielectric filter; and a plurality of holes extending through the dielectric body, each hole having a respective inner surface with a substantially constant cross-sectional shape along an axial direction of the corresponding hole;

at least one hole of said plurality of holes having a respective pair of internal conductors provided in the corresponding hole and conductively connected to said external conductor at respective ends of said corresponding hole, a respective non-conductive portion at said inner surface of the corresponding hole being spaced from both ends of said respective hole and thereby separating said corresponding pair of internal conductors and thereby defining a respective capacitance between said corresponding pair of internal conductors, a surface of said respective non-conductive portion being substantially flush with the rest of said inner surface of the corresponding hole; and signal input and output electrodes provided on the outer surface of the dielectric body and electrically isolated from said external conductor for providing capacitive coupling with respective internal conductors of two of the plurality of holes, and closely surrounded by said external conductor for providing capacitive coupling with said external conductor;

wherein the dielectric body includes end faces corresponding to said ends of said holes, a recess being disposed in the dielectric body in one of said end faces of the dielectric body, the external conductor extending into the recess disposed in the dielectric body and over a bottom surface of the recess.

4. The dielectric filter as claimed in claim 3, wherein said recess extends across said end face adjacent to each one of said plurality of holes.

5. The dielectric filter as claimed in claim 1, further comprising a second recess disposed in said one of said end faces of the dielectric body.

6. The dielectric filter as claimed in claim 2, further comprising a second recess disposed in said one of said end faces of the dielectric body.

7. The dielectric filter as claimed in claim 6, wherein said second recess extends across said one of said end faces adjacent to each one of said plurality holes, on an opposite side of said holes from said first-mentioned recess.

8. The dielectric filter as claimed in claim 3, further comprising a second recess disposed in said one of said end faces of the dielectric body, the external conductor extending into said second recess and over a bottom surface thereof.

9. The dielectric filter as claimed in claim 4, further comprising a second recess disposed in said one of said end faces of the dielectric body, the external conductor extending into said second recess and over a bottom surface thereof.

10. The dielectric filter as claimed in claim 9, wherein said second recess extends across said one of said end faces adjacent to each one of said plurality holes, on an opposite side of said holes from said first-mentioned recess.

11. A dielectric filter with surface electromagnetic shielding, comprising:

a dielectric body having an outer surface;

an external conductor substantially completely covering the outer surface of the dielectric body so as to provide said surface electromagnetic shielding of said dielectric filter; and at least one hole extending through the dielectric body, said hole having a respective inner surface with a substantially constant cross-section shape along an axial direction of the corresponding hole;

said at least one hole having a respective pair of internal conductors provided in the corresponding hole and conductively connected to said external conductor at respective ends of said corresponding hole, a respective non-conductive portion at said inner surface of the corresponding hole being spaced from both ends of said corresponding hole and thereby separating said corresponding pair of internal conductors and defining a respective capacitance between said corresponding pair of internal conductors, a surface of said respective non-conductive portion being substantially flush with the rest of said inner surface of the corresponding hole; and signal input and output electrodes provided on the outer surface of the dielectric body and electrically isolated from said external conductor for providing capacitive coupling with at least one of said internal conductors of said at least one hole, and closely surrounded by said external conductor for providing capacitive coupling with said external conductor;

wherein the dielectric body includes end faces corresponding to said ends of said hole, a recess being disposed in the dielectric body in one of said end faces of the dielectric body.

12. The dielectric filter as claimed in claim 11, wherein said recess extends across said end face adjacent to said at least one hole.

13. A dielectric filter with surface electromagnetic shielding, comprising:

a dielectric body having an outer surface;

an external conductor substantially completely covering the outer surface of the dielectric body so as to provide said surface electromagnetic shielding of said dielectric filter; and at least one hole extending through the dielectric body, said hole having a respective inner surface with a substantially constant cross-sectional shape along an axial direction of the corresponding hole;

said at least one hole having a respective pair of internal conductors provided in the corresponding hole and conductively connected to said external conductor at respective ends of said corresponding hole, a respective non-conductive portion at said inner surface of the corresponding hole being spaced from both ends of said corresponding hole and thereby separating said corresponding pair of internal conductors and defining a respective capacitance between said corresponding pair of internal conductors, a surface of said respective non-conductive portion being substantially flush with the rest of said inner surface of the corresponding hole; and signal input and output electrodes provided on the outer surface of the dielectric body and electrically isolated from said external conductor for providing capacitive coupling with at least one of said internal conductors of said at least one hole, and closely surrounded by said external conductor for providing capacitive coupling with said external conductor;

wherein the dielectric body includes end faces corresponding to said ends of said hole, a recess being disposed in the dielectric body in one of said end faces of the dielectric body, the external conductor extending into the recess disposed in the dielectric body and over a bottom surface of the recess.

14. The dielectric filter as claimed in claim 13, wherein said recess extends across said end face adjacent to said at least one hole.

15. The dielectric filter as claimed in claim 11, further comprising a second recess disposed in said one of said end faces of the dielectric body.

16. The dielectric filter as claimed in claim 12, further comprising a second recess disposed in said one of said end faces of the dielectric body.

17. The dielectric filter as claimed in claim 16, wherein said second recess extends across said end face adjacent to said at least one hole, on an opposite side of said hole from said first-mentioned recess.

18. The dielectric filter as claimed in claim 16, further comprising a second recess disposed in said one of said end faces of the dielectric body, the external conductor extending into said second recess and over a bottom surface thereof.

19. The dielectric filter as claimed in claim 14, further comprising a second recess disposed in said one of said end faces of the dielectric body, the external conductor extending into said second recess and over a bottom surface thereof.

20. The dielectric filter as claimed in claim 19, wherein said second recess extends across said end face adjacent to said at least one hole, on an opposite side of said hole from said first-mentioned recess.

* * * * *

UNITED STATES PATENT AND TRADEMARK OFFICE

CERTIFICATE OF CORRECTION

PATENT NO. : 5,896,074

DATED : Apr. 20, 1999

INVENTOR(S) : Matsumoto et al.

It is certified that error appears in the above-indentified patent and that said Letters Patent is hereby corrected as shown below:

On the title page, in the Foreign Application Priority Data, change "Oct. 20, 1992" to --October 28, 1992--.

Signed and Sealed this

Seventh Day of December, 1999

*Attest:*

*Attesting Officer*

Q. TODD DICKINSON

*Acting Commissioner of Patents and Trademarks*